US009240147B2

(12) United States Patent
Yasumoto

(10) Patent No.: US 9,240,147 B2
(45) Date of Patent: Jan. 19, 2016

(54) DISPLAY DEVICE

(71) Applicant: Alpine Electronics, Inc., Tokyo (JP)

(72) Inventor: Takashi Yasumoto, Fukushima (JP)

(73) Assignee: Alpine Electronics, Inc., Tokyo (JP)

( * ) Notice: Subject to any disclaimer, the term of this patent is extended or adjusted under 35 U.S.C. 154(b) by 366 days.

(21) Appl. No.: 13/793,171

(22) Filed: Mar. 11, 2013

(65) Prior Publication Data

US 2013/0307757 A1 Nov. 21, 2013

(30) Foreign Application Priority Data

May 17, 2012 (JP) ..... 2012-113426

(51) Int. Cl.
*G09G 3/36* (2006.01)

(52) U.S. Cl.
CPC ..... *G09G 3/36* (2013.01); *G09G 2320/0252* (2013.01); *G09G 2360/145* (2013.01); *G09G 2380/10* (2013.01)

(58) Field of Classification Search
CPC ..... G09G 3/36; G09G 2380/10; G09G 2360/145; G09G 2320/0252; B60K 2350/1004; B60K 2350/1064; B60K 2350/1068; B60K 2350/1072; B60K 2350/1032
USPC ..... 345/32, 87, 108–111; 340/7.55–7.56, 340/691.1–691.6, 688, 525, 441, 996, 340/995.24–995.28; 349/1; 348/148
See application file for complete search history.

(56) References Cited

U.S. PATENT DOCUMENTS 6,707,387 B2 * 3/2004 Noguchi ..... B60K 37/06 340/525
6,903,652 B2 * 6/2005 Noguchi ..... B60R 11/02 340/425.5
7,236,089 B2 * 6/2007 Ono ..... B60K 35/00 340/438
7,375,723 B2 5/2008 Cheon et al.
7,382,234 B2 6/2008 Yokota et al.
8,035,493 B2 * 10/2011 Hioki ..... B60K 35/00 340/425.5
8,531,283 B2 * 9/2013 Katayama ..... B60K 35/00 340/438
8,558,681 B2 * 10/2013 Nishiyama ..... B60K 35/00 116/288
8,558,683 B2 * 10/2013 Nishikawa ..... G01D 7/00 340/441
8,665,044 B2 * 3/2014 Lauder ..... G06F 1/1656 206/320
2003/0007227 A1 * 1/2003 Ogino ..... B60K 35/00 359/227
2007/0052875 A1 * 3/2007 Suzuki ..... B60K 37/02 349/1
2007/0155551 A1 * 7/2007 Luedtke ..... F16H 9/16 474/8
2008/0127883 A1 * 6/2008 Konagaya ..... G01D 13/265 116/286
2009/0002289 A1 * 1/2009 Chui ..... G09G 3/005 345/87
2011/0216045 A1 * 9/2011 Tsuchida ..... G06F 1/1616 345/204

(Continued)

FOREIGN PATENT DOCUMENTS

JP 2005-4203 1/2005

*Primary Examiner* — Kumar Patel
*Assistant Examiner* — Vinh Lam
(74) *Attorney, Agent, or Firm* — Brinks Gilson & Lione

(57) ABSTRACT

A display device includes movable members arranged to face a display screen of a liquid crystal display panel, a movable member driving mechanism, a display controller that controls the display of an image in a first display area and controls the display of a predetermined mark in a second display area on the liquid crystal display panel, and a drive controller that controls the movable member driving mechanism to move the movable members in accordance with a movement of the mark displayed. The display of an image object in the first display area and the display of the mark in the second display area are controlled so that the position of the image object displayed in the first display area corresponds to the position of the mark displayed in the second display area.

17 Claims, 16 Drawing Sheets

(56) References Cited

U.S. PATENT DOCUMENTS

2012/0068840 A1* 3/2012 Ozaki ..... B60R 1/00 340/456
2012/0069187 A1* 3/2012 Ozaki ..... B60R 1/00 348/148
2012/0188770 A1* 7/2012 Kunitachi ..... B60K 37/02 362/293
2012/0218493 A1* 8/2012 Funada ..... B60K 35/00 349/58
2012/0222612 A1* 9/2012 Amano ..... B60K 37/02 116/284
2012/0236483 A1* 9/2012 Watanabe ..... G02F 1/13336 361/679.01
2014/0063718 A1* 3/2014 Yasumoto ..... B60K 35/00 361/679.21
2014/0257653 A1* 9/2014 Sato ..... B60K 6/445 701/55

* cited by examiner

DISPLAY DEVICE

PRIORITY CLAIM

This application claims the benefit of Japanese Patent Application No. 2012-113426 filed on May 17, 2012, and which is incorporated by reference herein in its entirety.

BACKGROUND OF THE INVENTION

1. Field of the Invention

The present invention relates to a display device that displays an image on a display screen of a liquid crystal display panel.

2. Description of the Related Art

Display devices configured such that an image is displayed on a display screen of a liquid crystal display panel are known. In a display device having a liquid crystal display panel, the response speed of liquid crystal varies in accordance with variations in the temperature of the liquid crystal display panel due to changes in the ambient temperature or internal temperature of the display device. Hence, the variations in the response speed of liquid crystal may cause variations in the speed of switching between images on the display screen of the liquid crystal display panel or may cause variations in the motion on a moving image. For this reason, a display device of the related art (Japanese Unexamined Patent Application Publication No. 2005-4203) is configured to store compensation data in advance in a memory in association with temperatures, read the compensation data associated with the actual temperature from the memory when displaying an image, and control gray-scale data representing the image using the compensation data to correct for a reduction in response speed. This display device can suppress variations in the response speed of liquid crystal in a liquid crystal display panel, and provide stable display of an image (still image, moving image) on a display screen of the liquid crystal display panel.

A display device is available which includes a movable member arranged to face a display screen of a liquid crystal display panel and which is configured such that the movable member is moved and an image object displayed on the display screen is moved accordingly so that the movable member and the image object displayed on the display screen are associated with each other. For example, an on-vehicle display device ("cluster display device") is available which, as illustrated in FIGS. 1A and 1B, includes a first movable semi-circular frame member 20*a* and a second movable semi-circular frame member 20*b* which are shaped in semi-circular arcs. The first movable semi-circular frame member 20*a* and the second movable semi-circular frame member 20*b* are arranged to face a display screen 120 of a liquid crystal display panel 12. The first movable semi-circular frame member 20*a* and the second movable semi-circular frame member 20*b* are linearly moved and a first image object IOa of a speedometer and a second image object IOb of a tachometer, which are displayed on the display screen 120, are moved accordingly so that the first movable semi-circular frame member 20*a* and the first image object IOa (i.e., the speedometer) displayed on the display screen 120 are associated with each other and the second movable semi-circular frame member 20*b* and the second image object IOb (i.e., the tachometer) displayed on the display screen 120 are associated with each other. Such an on-vehicle display device provides a user with the image objects IOa and IOb (i.e., the speedometer and the tachometer) displayed on the display screen 120 of the liquid crystal display panel 12 as live views displayed integrally with the movable members (i.e., the first movable semi-circular frame member 20*a* and the second movable semi-circular frame member 20*b*).

In such a display device, it is desirable that the relative positions of the movable members with respect to the display screen of the liquid crystal display panel be detected. Using the relative positions allows the image objects to be displayed on the display screen of the liquid crystal display panel so that the positions of the image objects match the detected positions of the movable members, and also allows the movable members to move so that the detected positions of the movable members are associated with the positions of the image objects displayed on the display screen. The positions of the movable members may generally be detected using a potentiometer such as a linear position sensor (LPS).

The resistance of a potentiometer such as an LPS may vary due to temperature changes, and may also change with time. For this reason, it is desirable that corrected data for resistance values be stored in advance in association with temperatures in order to accurately detect the positions of the movable members using a potentiometer. In addition, it is also desirable that relationships between the positions and the resistance values be calibrated each time the potentiometer is used for a certain duration of time.

In order to move a movable member and move an image object displayed on the display screen accordingly so that the movable member and the image object displayed on the display screen are accurately associated with each other, as described above, a large amount of corrected data is required to correct the response speed of liquid crystal, and a large amount of corrected data is also required to correct the resistance of the potentiometer. Additionally, the characteristics of changes in the response speed of liquid crystal in accordance with temperature changes may differ depending on the type of liquid crystal (for example, twisted nematic (TN), vertical alignment (VA), or in-plane switching (IPS)). Hence, in terms of such types of liquid crystal, a larger amount of corrected data may be required. It is therefore difficult to move a movable member and move an image object displayed on a display screen accordingly so that the movable member and the image object displayed on the display screen are accurately associated with each other.

SUMMARY

In view of the foregoing, embodiments the present invention provides a display device capable of accurately associating a movable member and an image object displayed on a display screen with each other in a reliable manner.

In an aspect of the present invention, a display device includes a liquid crystal display panel having a display screen, a movable member, a movable member driving mechanism, a display controller, and a drive controller. The movable member is arranged to face the display screen of the liquid crystal display panel. The movable member driving mechanism is configured to drive the movable member to move while facing the display screen of the liquid crystal display panel. The display controller is configured to control display of an image in a first display area and a predetermined mark in a second display area. The first display area and the second display area are included in the display screen of the liquid crystal display panel. The drive controller is configured to control the movable member driving mechanism so that the movable member moves in accordance with movement of the mark displayed in the second display area on the display screen of the liquid crystal display panel under display control of the display controller. The display controller controls display of an image object in the first display area and the mark in the second display area on the display screen of the liquid crystal display panel so that a position of the image object displayed in the first display area and a position of the mark displayed in the second display area are related with each other.

With the configuration described above, a movable member arranged to face a display screen of a liquid crystal display panel moves in accordance with a movement of a mark, which is displayed in a second display area on the display screen of the liquid crystal display panel, in the second display area, and an image object is displayed in a first display area on the display screen of the liquid crystal display panel and the mark is displayed in the second display area so that the position of the image object displayed in the first display area is related with the position of the mark displayed in the second display area. As a result, the movement of the image object displayed in the first display area on the display screen of the liquid crystal display panel and the movement of the movable member arranged to face the display screen of the liquid crystal display panel are associated with each other through the mark displayed in the second display area on the display screen of the liquid crystal display panel.

In the display device, the display controller may include a first image display controller configured to control display of the image object in the first display area on the display screen of the liquid crystal display panel, and a second image display controller configured to control display of the mark in the second display area on the display screen of the liquid crystal display panel. The first image display controller and the second image display controller may control display of the image object in the first display area and the mark in the second display area so that the position of the image object displayed in the first display area and the position of the mark in the second display area on the display screen of the liquid crystal display panel are related with each other.

With the configuration described above, a first image display controller configured to control the display of the image object in the first display area on the display screen of the liquid crystal display panel and a second image display controller configured to control the display of the mark in the second display area allow the image object to be displayed in the first display area and the mark to be displayed in the second display area so that the position of the image object displayed in the first display area on the display screen of the liquid crystal display panel is related with the position of the mark displayed in the second display area.

In the display device, the first image display controller may include a displayed image object position controller configured to control the position of the image object displayed in the first display area in accordance with the position of the mark displayed in the second display area on the display screen of the liquid crystal panel.

With the configuration described above, the position of the image object displayed in the first display area is controlled in accordance with the position of the mark displayed in the second display area on the display screen of the liquid crystal display panel. At the same time, the movable member moves in accordance with the movement of the mark in the second display area. As a result, the image object is displayed at the position corresponding to the movable member in the first display area on the display screen of the liquid crystal display panel.

In the display device, the display controller may perform display control so that a background portion in the second display area on the display screen of the liquid crystal display panel is displayed with the same brightness as a dark portion in the image object displayed in the first display area and the mark is displayed with the same brightness as a bright portion in the image object displayed in the first display area, a difference in brightness between the bright portion and the dark portion being greater than or equal to a predetermined value.

With the configuration described above, in the second display area on the display screen of the liquid crystal display panel, a mark displayed with a brightness equal to that of, among a bright portion and a dark portion of an image object displayed in the first display area whose difference in brightness is greater than or equal to a certain value, the bright portion moves over a background portion displayed with a brightness equal to that of the dark portion.

In general, on a display screen of a liquid crystal display panel, the responsiveness of changes between a bright portion and a dark portion whose difference in degree of brightness is larger is better. For this reason, when the image object displayed in the first display area moves, in the second display area, a mark displayed with a brightness equal to that of, among a bright portion and a dark portion of the image object displayed in the first display area whose difference in brightness is greater than or equal to a certain value, the bright portion moves over a background portion displayed with a brightness equal to that of the dark portion. Thus, the movement of the image object displayed in the first display area can be relatively desirably associated with the movement of the mark displayed in the second display area. As a result, the movement of the movable member that moves in accordance with the movement of the mark displayed in the second display area can be more desirably associated with the movement of the image object displayed in the first display area.

In the display device, the bright portion may be a brightest portion in the image object, and the dark portion may be a darkest portion in the image object.

With the configuration described above, in the second display area on the display screen of the liquid crystal display panel, the mark displayed with a brightness equal to that of the brightest portion in the image object displayed in the first display area moves over the background portion displayed with a brightness equal to that of the darkest portion in the image object. Thus, the movement of the image object displayed in the first display area can be further desirably associated with the movement of the mark displayed in the second display area. Therefore, the movement of the movable member that moves in accordance with the movement of the mark displayed in the second display area can be further desirably associated with the movement of the image object displayed in the first display area.

In the display device, the drive controller may include a mark movement detector configured to detect movement of the mark displayed in the second display area on the display screen of the liquid crystal display panel, and an operation controller configured to control an operation of the movable member driving mechanism in accordance with the movement of the mark detected by the mark movement detector.

With the configuration described above, the movement of the mark displayed in the second display area on the display screen of the liquid crystal display panel can be detected, and the operation of the movable member driving mechanism is controlled in accordance with the detected movement of the mark. Thus, the movable member can be moved in accordance with the movement of the mark displayed so as to move in the second display area.

In the display device, the movable member driving mechanism may be configured to drive the movable member to linearly reciprocally move while facing the display screen of the liquid crystal display panel, and the second display area on the display screen of the liquid crystal display panel may extend in the same direction as a trajectory of the movable member.

With the configuration described above, the movable member is linearly moved in accordance with the movement of the mark moving in the second display area on the display screen of the liquid crystal display panel, while facing the display screen of the liquid crystal display panel.

In the display device, the drive controller may include a mark movement detector configured to detect movement of the mark displayed in the second display area on the display screen of the liquid crystal display panel, and an operation controller configured to control an operation of the movable member driving mechanism, based on the movement of the mark detected by the mark movement detector, so that the movable member moves to follow the movement of the mark moving in the second display area on the display screen of the liquid crystal display panel.

With the configuration described above, the movement of the mark displayed in the second display area on the display screen of the liquid crystal display panel can be detected, and, based on the detected movement of the mark, the movable member can be moved to follow the movement of the mark in the second display area.

In the display device, the mark movement detector may include a plurality of light detectors arranged to face the second display area on the display screen of the liquid crystal display panel and configured to detect light emitted from the mark displayed in the second display area. A change in level of the light detected by each of the plurality of light detectors may be detected as a movement of the mark.

With the configuration described above, when the relative positional relationships between the mark moving in the second display area on the display screen of the liquid crystal display panel and a plurality of light detectors arranged to face the second display area change, a change in level of light emitted from the mark which is detected by each of the plurality of light detectors can be detected as a movement of the mark.

In the display device, the plurality of light detectors may be provided integrally in the movable member.

With the configuration described above, a change in level of the light from the mark moving in the second display area on the display screen of the liquid crystal display panel, which is detected by each of the plurality of light detectors, can be directly associated with a movement of the movable member facing the second display area.

In the display device, the plurality of light detectors may include a first light detector and a second light detector which are placed at a predetermined interval therebetween in a direction in which the second display area extends on the display screen of the liquid crystal display panel. The operation controller may control the movable member driving mechanism to drive the movable member to move so that a difference between a level of the light detected by the first light detector and a level of the light detected by the second light detector is maintained within a predetermined range.

With the configuration described above, when the mark moves in the second display area on the display screen of the liquid crystal display panel, the movable member moves so that the difference between levels of the light emitted from the mark which are detected by a first light detector and a second light detector that are provided integrally in the movable member and that are placed at a predetermined interval therebetween in a direction in which the second display area extends is maintained within a predetermined range.

In the display device, the display screen of the liquid crystal display panel may be rectangular, and the display screen may include an area having a first width from a top side thereof, and an area below the first display area and having a second width smaller than the first width. The area having the first width is set as the first display area and the area having the second width is set as the second display area.

With the configuration described above, on a rectangular display screen of the liquid crystal display panel, an image object displayed in a first display area and a mark displayed in a second display area below the first display area can move in the first display area and the second display area, respectively, so that the lateral position of the image object displayed in the first display area and the lateral position of the mark displayed in the second display area are related with each other.

A display device according to an embodiment of the present invention may be configured such that a movement of an image object displayed in a first display area on a display screen of a liquid crystal display panel and a movement of a movable member arranged to face the display screen of the liquid crystal display panel are associated with each other through a mark displayed in a second display area having the same response speed characteristics as the first display area in which the image object is displayed. Therefore, the movable member and the image object displayed on the display screen can be accurately associated with each other in a simple manner.

DETAILED DESCRIPTION

Embodiments of the present invention will be described with reference to the drawings.

Figure 1A:
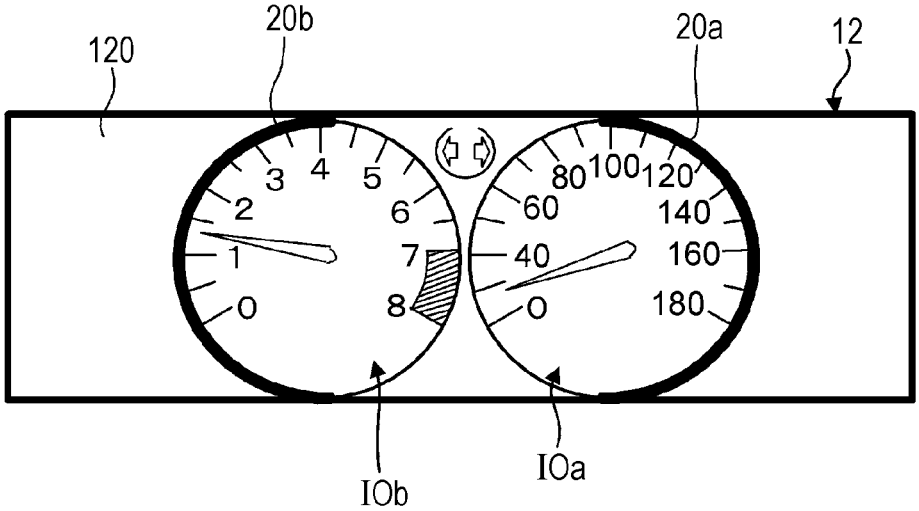
FIG. 1A is a diagram illustrating an example (first portion) in which image objects (a speedometer and a tachometer) are displayed on a display screen of a liquid crystal display panel in accordance with a first movable semi-circular frame member and a second movable semi-circular frame member which are arranged to face the display screen.
Figure 1B:
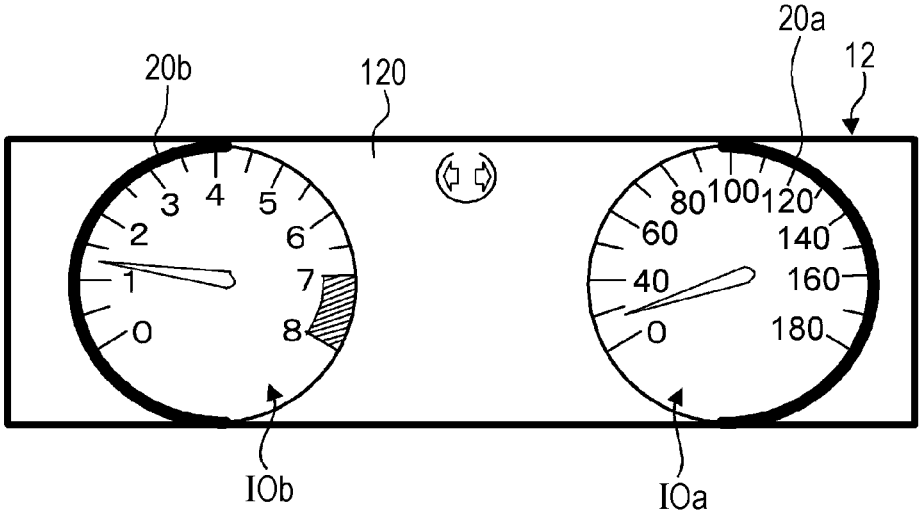
FIG. 1B is a diagram illustrating the example (second portion) in which the image objects (the speedometer and the tachometer) are displayed on the display screen of the liquid crystal display panel in accordance with the first movable semi-circular frame member and the second movable semi-circular frame member which are arranged to face the display screen.
Figure 2:
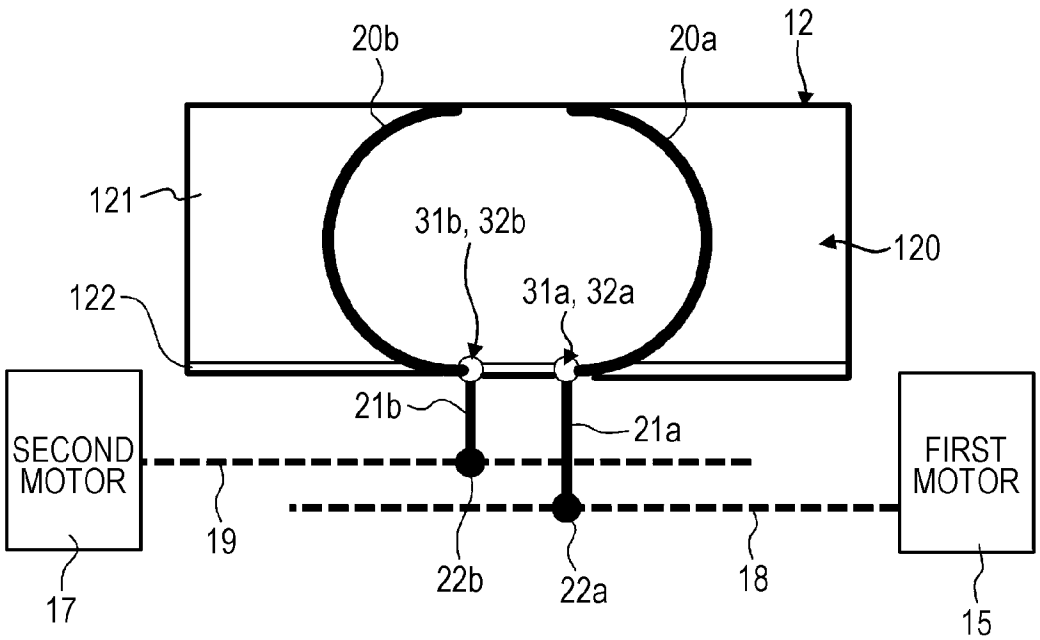
FIG. 2 is a diagram illustrating a basic configuration of a mechanism system of a display device according to an embodiment of the present invention.

FIG. 2 illustrates a configuration of a mechanism system of a display device according to an embodiment of the present invention. The display device may be an on-vehicle display device mounted on a vehicle and configured to display information necessary for the vehicle.

In FIG. 2, a liquid crystal display panel 12 has a rectangular display screen 120. A first movable semi-circular frame member 20*a* and a second movable semi-circular frame member 20*b* are arranged to face the display screen 120. The first movable semi-circular frame member 20*a* and the second movable semi-circular frame member 20*b* are capable of reciprocally moving along the display screen 120, and form a ring-shaped frame member when joining each other. The first movable semi-circular frame member 20*a* has a first support portion 21*a* extending downward from the bottom end thereof. A mechanism (movable member driving mechanism) for driving the first movable semi-circular frame member 20*a* includes a first screw sleeve 22*a*, a first motor 15 (stepping motor), and a first screw bar 18. The first screw sleeve 22*a* is fixed to the leading end of the first support portion 21*a*, and the first screw bar 18, which is rotated by the first motor 15, is screwed into the first screw sleeve 22*a*. When the first screw bar 18 is rotated by the first motor 15, the first screw sleeve 22*a* moves in a direction corresponding to the rotation direction of the first screw bar 18, and therefore the first movable semi-circular frame member 20*a* fixed to the first screw sleeve 22*a* through the first support portion 21*a* linearly moves while facing the display screen 120 of the liquid crystal display panel 12. The second movable semi-circular frame member 20*b* has a second support portion 21*b* extending from the bottom end thereof. A mechanism (movable member driving mechanism) for driving the second movable semi-circular frame member 20*b* includes a second screw sleeve 22*b*, a second motor 17 (stepping motor), and a second screw bar 19. The second screw sleeve 22*b* is fixed to the leading end of the second support portion 21*b*, and the second screw bar 19, which is rotated by the second motor 17, is screwed into the second screw sleeve 22*b*. When the second screw bar 19 is rotated by the second motor 17, the second screw sleeve 22*b* moves in a direction corresponding to the rotation direction of the second screw bar 19, and therefore the second movable semi-circular frame member 20*b* fixed to the second screw sleeve 22*b* through the second support portion 21*b* linearly moves while facing the display screen 120 of the liquid crystal display panel 12.

Figure 3:
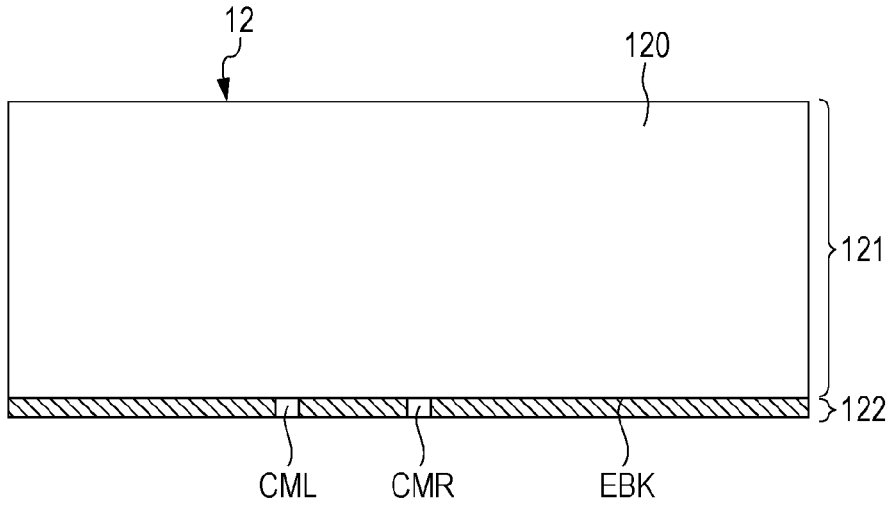
FIG. 3 is a diagram illustrating a configuration of areas on a display screen of a liquid crystal display panel.

As illustrated in FIG. 3, the display screen 120 of the liquid crystal display panel 12 includes an image display area 121 (first display area) where an image based on image data is displayed, and a mark display area 122 (second display area) continuously formed downward from the image display area 121. The image display area 121 is an area having a first width corresponding to a predetermined number of pixels (for example, 479 pixels among a total of 480 pixels in the vertical direction) from the top side thereof. The mark display area 122 is an area having a second width corresponding to a predetermined number of pixels (for example, one pixel) smaller than the number of pixels corresponding to the first width.

Figure 4:
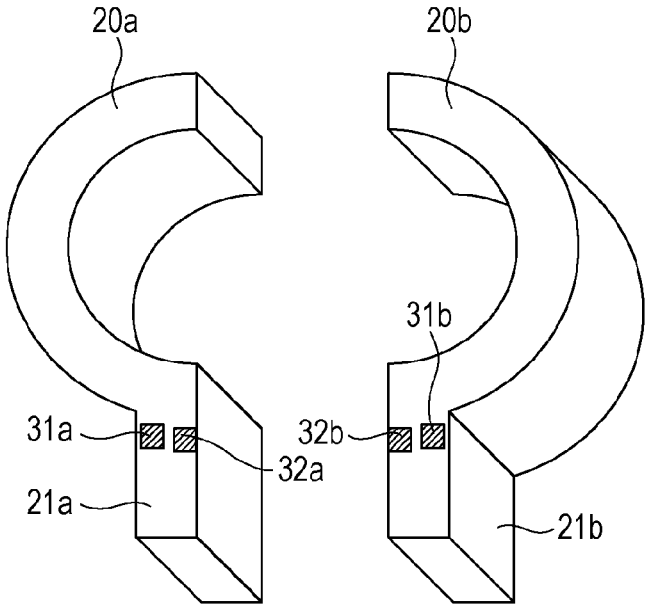
FIG. 4 is a perspective view illustrating an example of the structure of movable members arranged to face the display screen of the liquid crystal display panel.

In the mark display area 122, as described below, a relatively bright first mark CMR (for example, dot mark) associated with the first movable semi-circular frame member 20*a* and a relatively bright second mark CML (for example, dot mark) associated with the second movable semi-circular frame member 20*b* are displayed in a relatively dark (low-brightness, low-density) background portion EBK. As illustrated in FIG. 2 and also illustrated in an enlarged manner in FIG. 4, a portion of the first support portion 21*a* continuous to the first movable semi-circular frame member 20*a* arranged to face the display screen 120 of the liquid crystal display panel 12, which faces the mark display area 122, has a first photosensor 31*a* (first light detector) and a second photosensor 32*a* (second light detector). The first photosensor 31*a* and the second photosensor 32*a* are placed at a predetermined interval therebetween in a direction in which the mark display area 122 extends. Further, as illustrated in FIG. 2 and also illustrated in an enlarged manner in FIG. 4, a portion of the second support portion 21*b* continuous to the second movable semi-circular frame member 20*b* arranged to face the display screen 120 of the liquid crystal display panel 12, which faces the mark display area 122, has a first photosensor 31*b* (first light detector) and a second photosensor 32*b* (second light detector). The first photosensor 31*b* and the second photosensor 32*b* are also placed at a predetermined interval therebetween in the direction in which the mark display area 122 extends.

The first photosensor 31*a* and second photosensor 32*a* provided for the first movable semi-circular frame member 20*a* are configured to detect light emitted from the first mark CMR displayed in the mark display area 122 on the display screen 120 of the liquid crystal display panel 12, and output detection signals having levels corresponding to the intensities of the detected light. The first photosensor 31*b* and second photosensor 32*b* provided for the second movable semi-circular frame member 20*b* are configured to detect light emitted from the second mark CML displayed in the mark display area 122, and output detection signals having levels corresponding to the intensities of the detected light.

Figure 5:
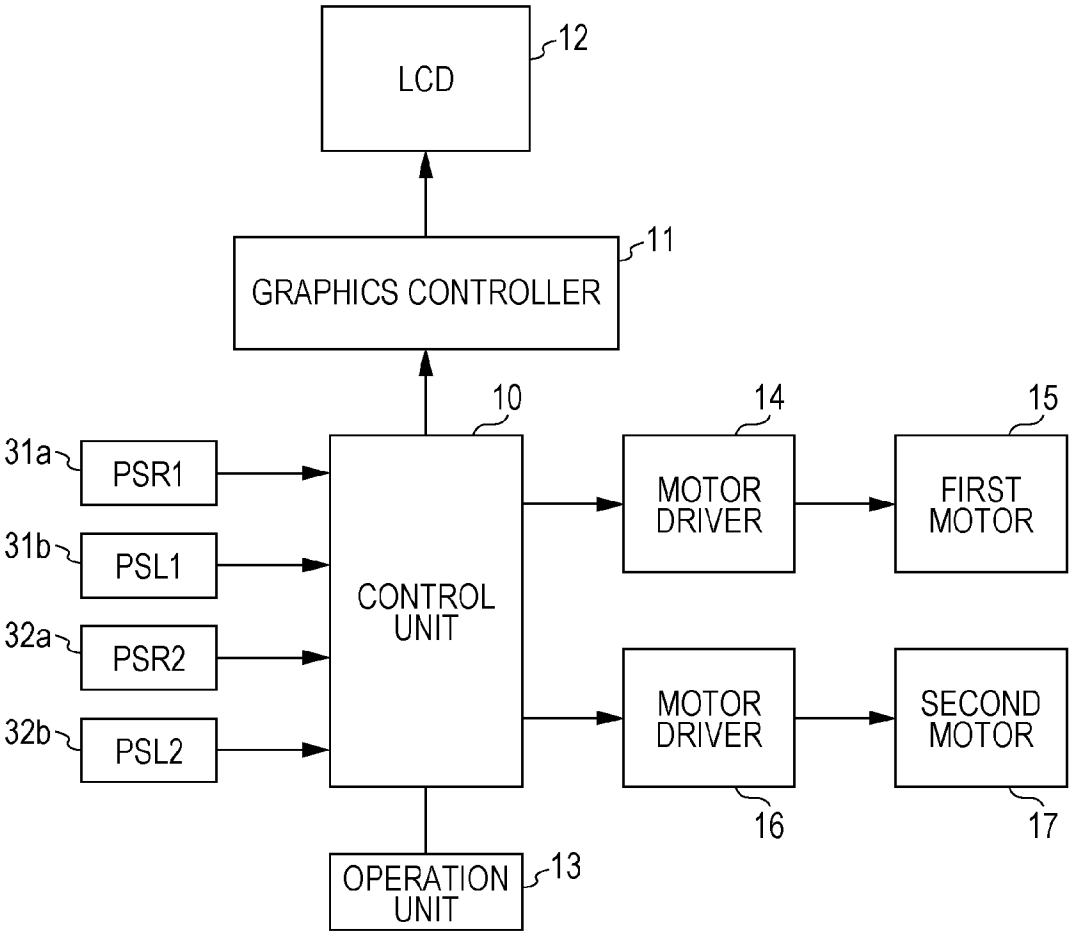
FIG. 5 is a block diagram illustrating a basic configuration of a control processing system of the display device according to the embodiment of the present invention.

The display device includes a control processing system having a configuration illustrated in FIG. 5.

In FIG. 5, the display device includes a control unit 10, a graphics controller 11, and an operation unit 13. The graphics controller 11 controls the display of an image in the image display area 121 on the display screen 120 of the liquid crystal display panel 12 and the display of the background portion EBK and the first and second marks CMR and CML (see FIG. 3) in the mark display area 122 under control of the control unit 10 based on the operation using the operation unit 13. The first photosensor 31*a* (PSR1) and the second photosensor 32*a* (PSR2) provided for the first movable semi-circular frame member 20*a* and the first photosensor 31*b* (PSL1) and the second photosensor 32*b* (PSL2) provided for the second movable semi-circular frame member 20*b* are connected to the control unit 10.

The control unit 10 functions as a drive controller for the mechanism (including the first motor 15) for driving the first movable semi-circular frame member 20*a*, and outputs a drive control signal to the first motor 15 in accordance with the detection signals from the first photosensor 31*a* (PSR1) and the second photosensor 32*a* (PSR2) provided for the first movable semi-circular frame member 20*a*. A motor driver 14 drives the first motor 15 in accordance with the drive control signal. The control unit 10 also functions as a drive controller for the mechanism (including the second motor 17) for driving the second movable semi-circular frame member 20*b*, and outputs a drive control signal to the second motor 17 in accordance with the detection signals from the first photosensor 31*b* (PSL1) and the second photosensor 32*b* (PSL2) provided for the second movable semi-circular frame member 20*b*. A motor driver 16 drives the second motor 17 in accordance with the drive control signal.

The control unit 10 may include various hardware and software components, which may be integrated into the control unit or may be separate and apart therefrom. For example, the control unit 10 may include a display control unit, which may further include a first image display control unit, a second image display control unit, a displayed image object position control unit, and a mark movement detection unit. Other components and sub-components may be included. The functions carried out by the components included in the control unit 10 may be performed by a specific hardware components or in some embodiments, may be carried out by a processor under software control.

The graphics controller 11 may also include various hardware and software components, which may be integrated into the control unit or may be separate and apart therefrom. The functions carried out by the components included in the graphics controller 11 may be performed by a specific hardware component or may be carried out by a processor under software control.

Specific control of the driving mechanisms (the first motor 15 and the second motor 17) of the first movable semi-circular frame member 20*a* and the second movable semi-circular frame member 20*b* by using the control unit 10 will be described with reference to FIGS. 6A to 6C. While FIGS. 6A to 6C illustrate the operation of the first movable semi-circular frame member 20*a*, the operation of the second movable semi-circular frame member 20*b* may be performed in a similar manner.

Figure 6A:
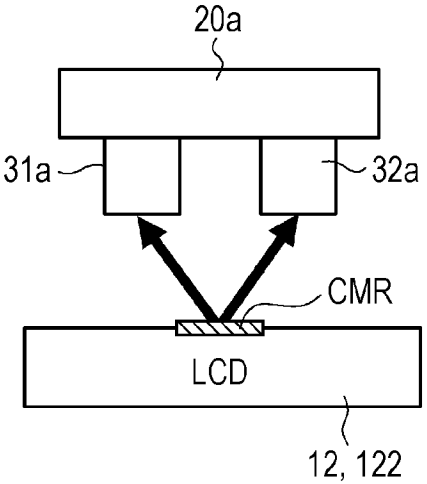
FIGS. 6A to 6C are diagrams schematically illustrating relationships between movements of a mark displayed in a mark display area on the display screen of the liquid crystal display panel and movements of a first movable semi-circular frame member on which a first light receiving element and a second light receiving element are integrally formed.
Figure 6B:
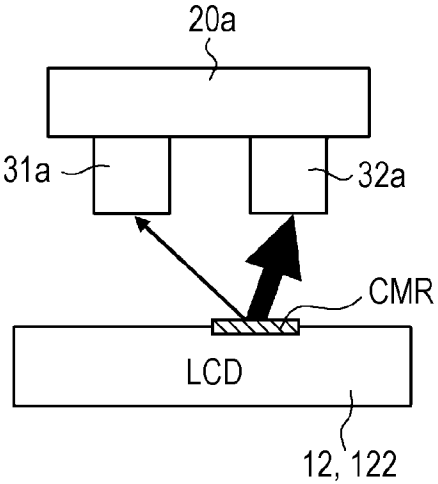
Figure 6C:
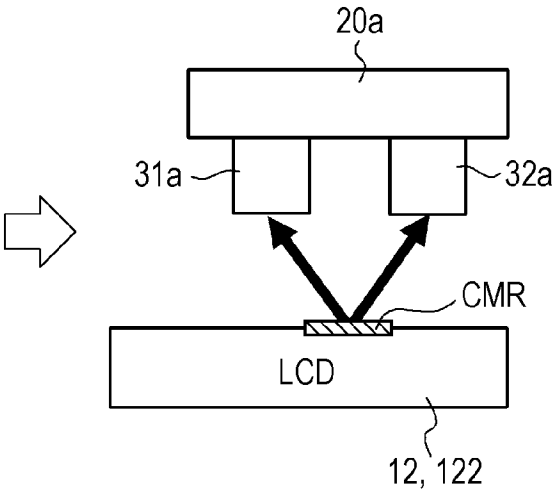
Figure 7A:
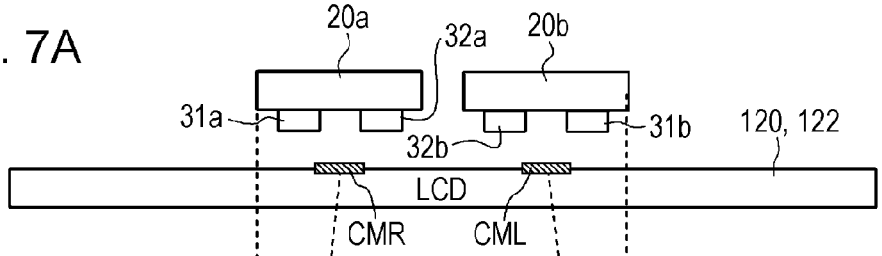
FIGS. 7A to 7E are diagrams illustrating relationships between movements of two marks displayed in the mark display area on the display screen of the liquid crystal display panel, movements of the first movable semi-circular frame member on which the first light receiving element and the second light receiving element are integrally formed, and movements of a second movable semi-circular frame member on a first light receiving element and a second light receiving element are integrally formed.
Figure 7B:
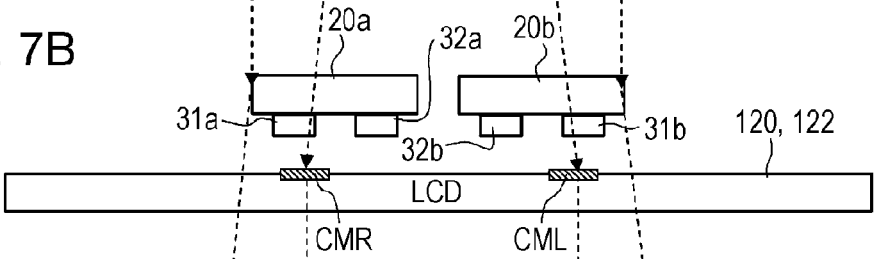
Figure 7C:
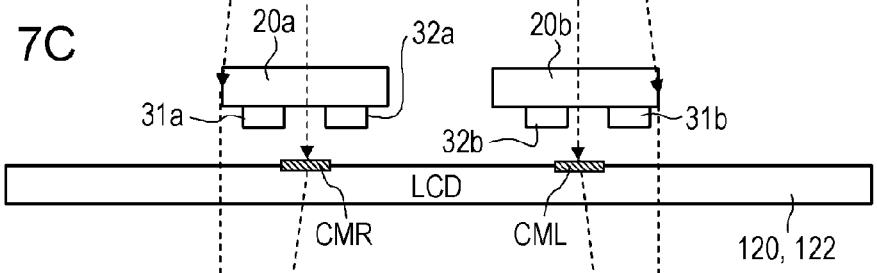
Figure 7D:
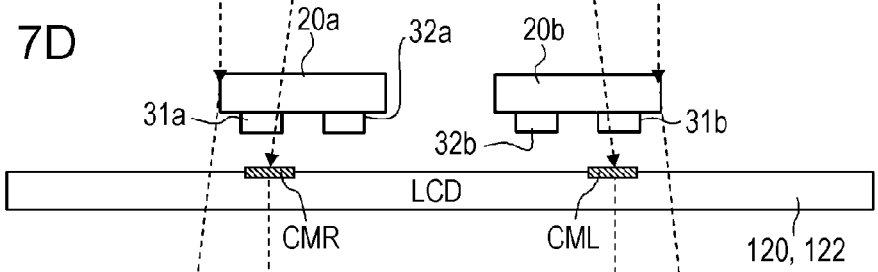
Figure 7E:
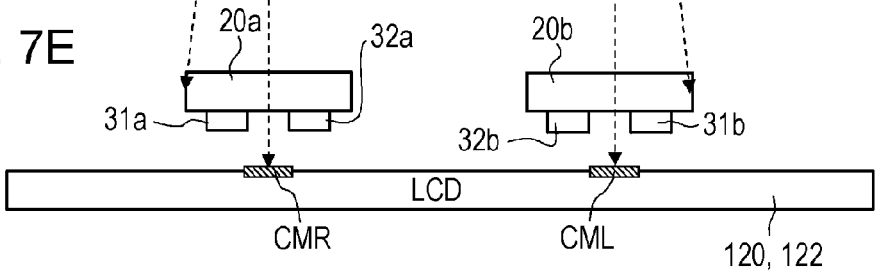

The first movable semi-circular frame member 20*a* is located at a position where the difference between the levels of the light emitted from the first mark CMR displayed in the mark display area 122 on the display screen 120 of the liquid crystal display panel 12, which are detected by the first photosensor 31*a* and the second photosensor 32*a*, is maintained within a predetermined range (see FIG. 6A). As a result of the movement of the first mark CMR displayed in the mark display area 122, for example, if the level detected by the second photosensor 32*a* is higher than the level detected by the first photosensor 31*a* and the difference between the detected levels exceeds the predetermined range (see FIG. 6B), the driving of the first motor 15 is controlled to move the first movable semi-circular frame member 20*a* in a direction in which the first photosensor 31*a* approaches the first mark CMR and the second photosensor 32*a* moves away from the first mark CMR in order to keep the difference between the detected levels within the predetermined range. Because of the operation of the first motor 15, the first movable semi-circular frame member 20*a* is moved until the difference between the detected level of the first photosensor 31*a* and the detected level of the second photosensor 32*a* falls within the predetermined range (see FIG. 6C). In this manner, the control unit 10, while causing the first mark CMR to move in the mark display area 122 on the display screen 120, detects the movement of the first mark CMR (a mark movement detector) in accordance with the change in the difference between the levels of the light emitted from the first mark CMR, which are detected by the first photosensor 31*a* and the second photosensor 32*a*, and controls the operation of the first motor 15 (an operation controller for the first motor 15) so that the first movable semi-circular frame member 20*a* is moved to follow the first mark CMR. The control unit 10 also, while causing the second mark CML to move in the mark display area 122 on the display screen 120, detects the movement of the second mark CML (a mark movement detector) in accordance with the change in the difference between the levels of the light emitted from the second mark CML, which are detected by the first photosensor 31*b* and the second photosensor 32*b*, and controls the operation of the second motor 17 (an operation controller for the second motor 17) so that the second movable semi-circular frame member 20*b* is moved to follow the second mark MCL.

In this manner, the functions of the control unit 10 serving as a mark movement detector and operation controllers for the first motor 15 and the second motor 17 allow the first movable semi-circular frame member 20*a* and the second movable semi-circular frame member 20*b* to move to follow the first mark CMR and the second mark CML moving in the mark display area 122 on the display screen 120 in a manner as illustrated in FIGS. 7A, 7B, 7C, 7D, and 7E while facing the display screen 120 of the liquid crystal display panel 12.

Figure 8A:
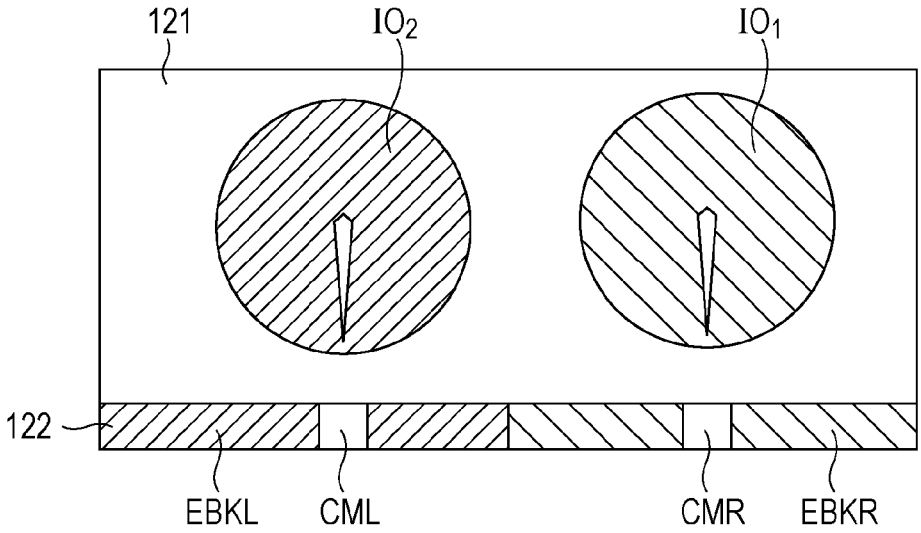
FIG. 8A is a diagram (first portion) illustrating an image display area (first display area) where two image objects are displayed and a mark display area (second display area) where two marks are displayed.
Figure 8B:
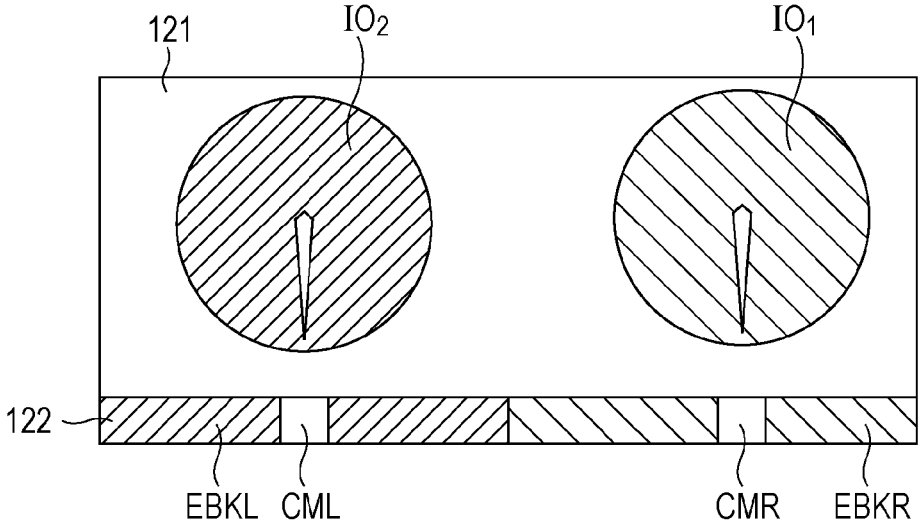
FIG. 8B is a diagram (second portion) illustrating the image display area (first display area) where the two image objects are displayed and the mark display area (second display area) where the two marks are displayed.

Further, as illustrated in FIGS. 8A and 8B, the control unit 10, together with the graphics controller 11, controls the display of an image in the image display area 121 on the liquid crystal display panel 12 and the display of the first mark CMR and the second mark CML in the mark display area 122 described above. Specifically, the display of image objects IO1 and IO2 in the image display area 121 and the display of the first mark CMR and the second mark CML in the mark display area 122 are controlled so that the position of the image object IO1 displayed in the image display area 121 and the position of the first mark CMR displayed in the mark display area 122 are related with each other and the relative positional relationship therebetween is maintained, and so that the position of the image object IO2 displayed in the image display area 121 and the position of the second mark CML displayed in the mark display area 122 are related with each other and the relative positional relationship therebetween is maintained. Thus, the image object IO1 in the image display area 121 and the first mark CMR in the mark display area 122 are moved in a similar manner, and the image object IO2 in the image display area and the second mark CML in the mark display area 122 are moved in a similar manner (see FIGS. 8A and 8B).

The movement of an image object and a mark may be indicated by turning on and off individual pixels on the display screen 120.

The relative positional relationship between the image object IO1 displayed in the image display area 121 and the first mark CMR displayed in the mark display area 122 is determined so that the image object IO1 can be displayed so as to have a predetermined positional relationship with the first movable semi-circular frame member 20*a* (see FIGS. 6A to 6C and FIGS. 7A to 7E) positioned with respect to the first mark CMR. Further, the relative positional relationship between the image object IO2 displayed in the image display area 121 and the second mark CML displayed in the mark display area 122 is determined so that the image object IO2 can be displayed so as to have a predetermined positional relationship with the second movable semi-circular frame member 20*b* (see FIGS. 6A to 6C and FIGS. 7A to 7E) positioned with respect to the second mark CML.

The display in the mark display area 122 is controlled so that within the movement range of the first mark CMR, the background portion EBKR has a grayscale value corresponding to the darkest portion in the image object IO1 and the first mark CMR has a grayscale value corresponding to the brightest portion in the image object IO1. The display in the mark display area 122 is also controlled so that within the movement range of the second mark CML, the background portion EBKL has a grayscale value corresponding to the darkest portion in the image object IO2 and the second mark CML has a grayscale value corresponding to the brightest portion in the image object IO2.

Figure 9:
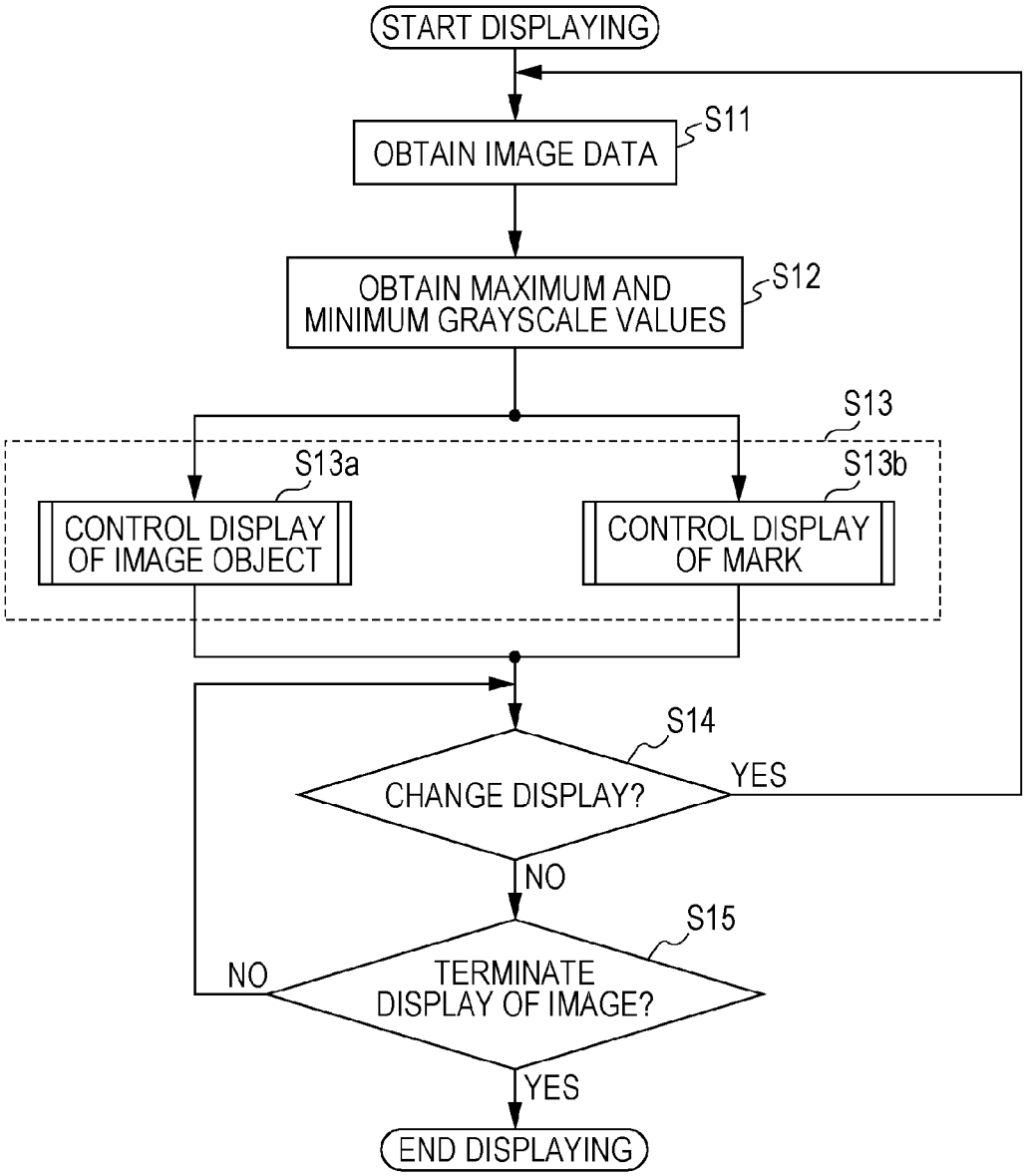
FIG. 9 is a flowchart illustrating a procedure of a display process executed by a control unit.
Figure 10:
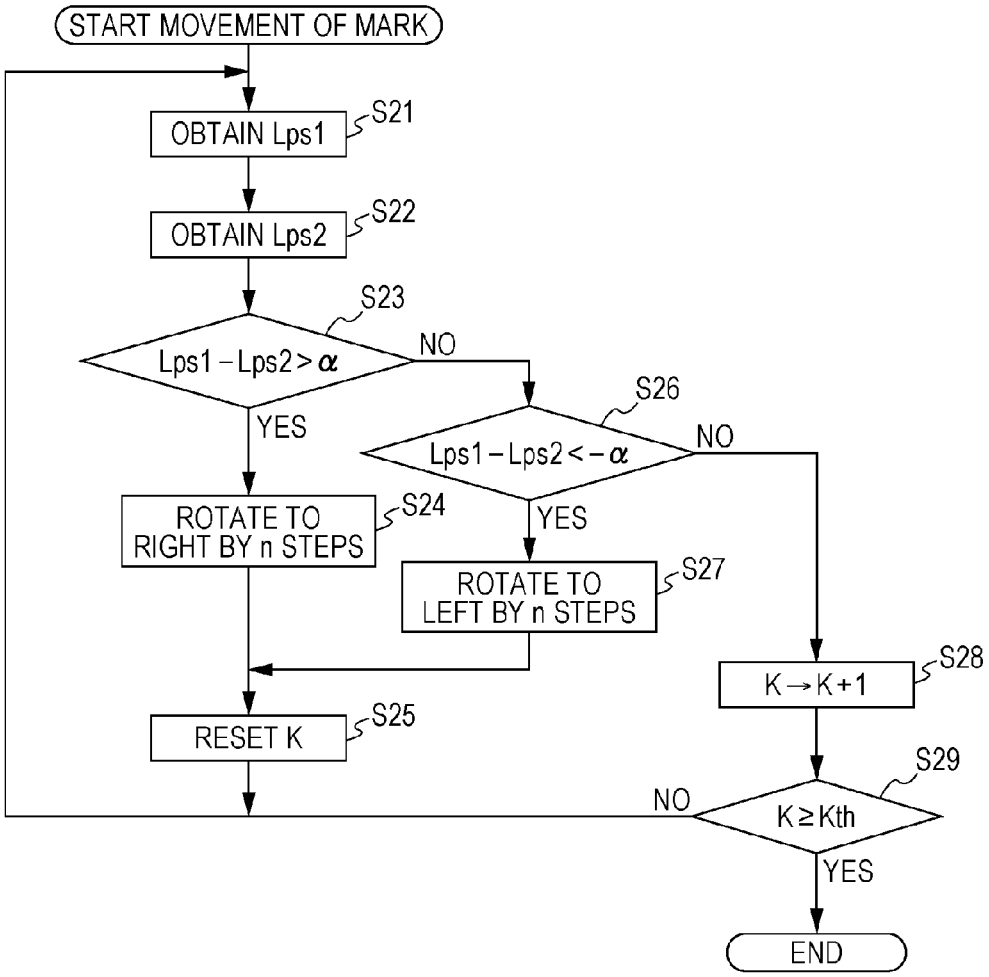
FIG. 10 is a flowchart of a processing procedure for controlling the operation of movable members (the first movable semi-circular frame member and the second movable semi-circular frame member), which is executed by the control unit.

The control unit 10 controls the display of an image and a mark on the display screen 120 of the liquid crystal display panel 12 in accordance with a procedure illustrated in FIG. 9, and also controls the operation of the first movable semi-circular frame member 20*a* and the second movable semi-circular frame member 20*b* in accordance with a procedure illustrated in FIG. 10.

Figure 11A:
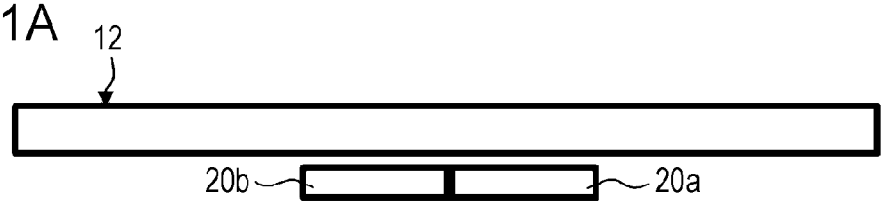
FIGS. 11A and 11B are a plan view and a front view, respectively, of the first movable semi-circular frame member and the second movable semi-circular frame member when joining each other in an initial state.
Figure 11B:
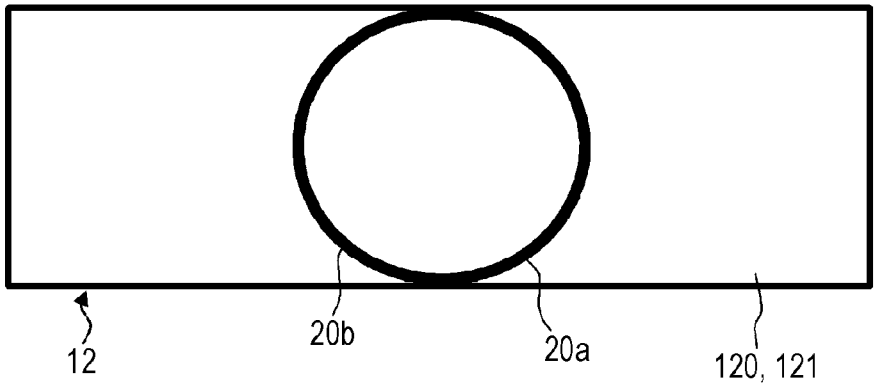

In the initial state, for example, as illustrated in FIGS. 11A and 11B, the first movable semi-circular frame member 20*a* and the second movable semi-circular frame member 20*b* are located substantially in the center portion of the display screen 120 by the first mark CMR and the second mark CML (see FIGS. 6A to 6C and FIGS. 7A to 7E) displayed in the mark display area 122 on the display screen 120 of the liquid crystal display panel 12, and join each other to form a ring-shaped frame member. In this state, for example, when an ignition key for the vehicle is turned on, a process for the display on the liquid crystal display panel 12 is started in accordance with the procedure illustrated in FIG. 9.

Figure 12A:
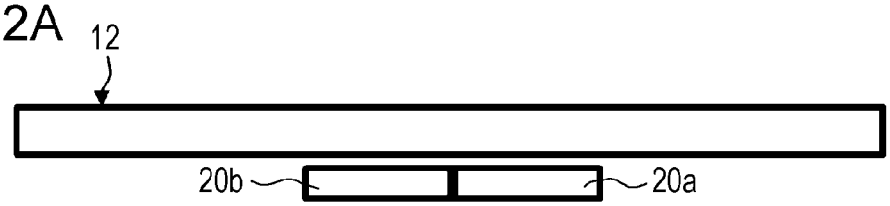
FIGS. 12A and 12B are a plan view and a front view, respectively, of the first movable semi-circular frame member and the second movable semi-circular frame member when joining each other in the initial state, and the liquid crystal display panel on which an image object is displayed on the display screen (namely, in the image display area) in association with the first movable semi-circular frame member and the second movable semi-circular frame member.
Figure 12B:
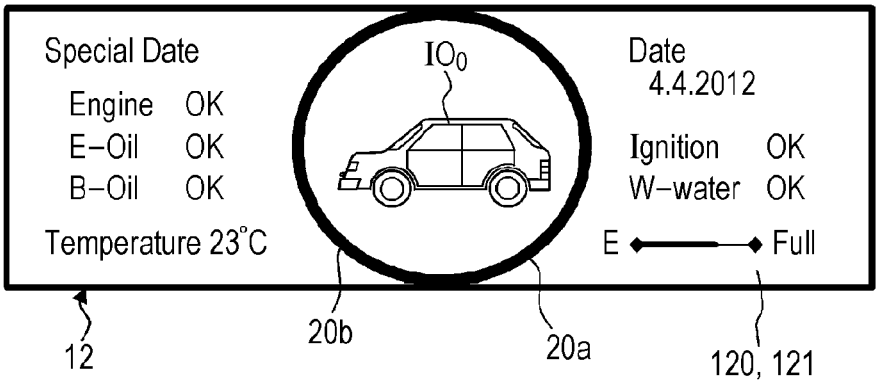

In FIG. 9, the control unit 10 obtains image data of the initial screen (S11), and obtains the grayscale value of the brightest portion (maximum grayscale value) and the grayscale value of the darkest portion (minimum grayscale value) of an image object included in the image data (S12). Then, the control unit 10 controls the display of the first mark CMR and the second mark CML in the mark display area 122, which have the maximum grayscale values with respect to the background portions having the minimum grayscale values, so that, for example, as illustrated in FIGS. 12A and 12B, the first movable semi-circular frame member 20*a* and the second movable semi-circular frame member 20*b* are still maintained substantially at the center portion of the display screen 120 (S13*b*: a second image display controller). Then, the control unit 10 controls the display of the first movable semi-circular frame member 20*a* and the second movable semi-circular frame member 20*b* on the basis of the positions of the first mark CMR and the second mark CML so that initial screen images including image objects having a predetermined positional relationship are displayed in the image display area 121 (S13*a*: a first image display controller (a displayed image object position controller)). Thus, for example, as illustrated in FIG. 12B, an initial screen image is displayed in the image display area 121 so that an image object IO0 (for example, an image object of an overall vehicle body) is located in the ring-shaped frame member formed by joining the first movable semi-circular frame member 20*a* and the second movable semi-circular frame member 20*b*, and information such as results of examination at the start of the vehicle is located outside the ring-shaped frame member.

Figure 13A:
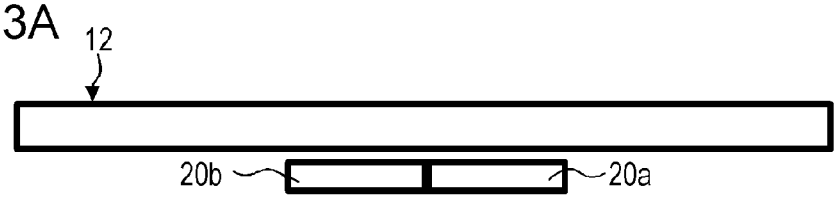
FIGS. 13A and 13B are a plan view and a front view, respectively, of the first movable semi-circular frame member and the second movable semi-circular frame member when joining each other in the initial state, and the liquid crystal display panel on which another image object is displayed on the display screen (namely, in the image display area) in association with the first movable semi-circular frame member and the second movable semi-circular frame member.
Figure 13B:
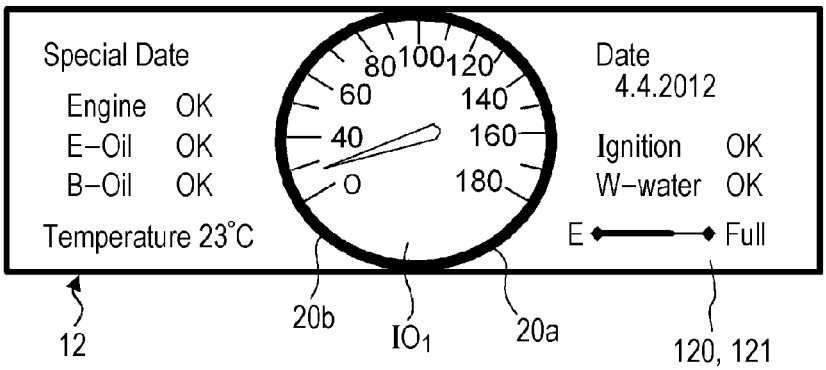

Thereafter, the control unit 10 repeatedly determines whether or not to change the display (S14) and whether or not an operation of terminating the display of the image has been performed through the operation unit 13 (S15). During this process, if a predetermined period of time has elapsed since the display of the initial screen image described above was started and it is determined that the display is to be changed (YES in S14), the control unit 10 obtains the changed image data, for example, image data representing an image including an image object of a speedometer, which may be necessary for the travel of the vehicle (S11). Then, as illustrated in FIGS. 13A and 13B, the control unit 10 continuously controls the display of the first mark CMR and the second mark CML in the mark display area 122 in a manner similar to that described above to maintain the first movable semi-circular frame member 20*a* and the second movable semi-circular frame member 20*b* substantially at the center portion of the display screen 120 (S12, S13*b*). Then, the control unit 10 performs display control for the image display area 121 on the basis of the positions of the first mark CMR and the second mark CML so that, for example, as illustrated in FIG. 13B, an image object IO1 of a speedometer (hereinafter referred to as the speedometer object IO1) in place of the image object IO0 of the initial screen (see FIG. 12B) is located in the ring-shaped frame member formed by joining the first movable semi-circular frame member 20*a* and the second movable semi-circular frame member 20*b* (S13*a*).

Thereafter, the control unit 10 determines that the display is to be changed in order to, for example, move the speedometer object IO1 to the correct position (see FIG. 14B) (YES in S14). Then, the control unit 10 obtains new image data including the speedometer object IO1 (S11). Then, the control unit 10 obtains the grayscale value corresponding to the brightest portion (that is, the maximum grayscale value) and the grayscale value of the darkest portion (that is, the minimum grayscale value) of the speedometer object IO1 to be moved in the image display area 121, from the image data provided for display (S12). Then, the control unit 10 performs display control so that, for example, the speedometer object IO1 displayed in the image display area 121 is moved to the right from the center portion in the image display area 121 while maintaining the speedometer object IO1 and the first mark CMR having the maximum grayscale value displayed in the background portion EBKR having the minimum grayscale value in the mark display area 122 to have the predetermined positional relationship (S13*a*), and also performs display control so that the first mark CMR is moved to the right from the center portion in the mark display area 122 (S13*b*) (see FIGS. 8A and 8B).

Although no image object is displayed in the image display area 121 in association with the second mark CML, the second mark CML is displayed so as to have the same grayscale value as the first mark CMR under the display control of the mark (S13*b*), and is symmetrically moved in a direction (to the left) opposite to the direction of movement of the first mark CMR from the center portion of the mark display area 122.

As described above, during the movement of the speedometer object IO1 in the image display area 121 and the movement of the first mark CMR in the mark display area 122, the control unit 10 controls the operation of the first movable semi-circular frame member 20*a* in accordance with the procedure illustrated in FIG. 10. In FIG. 10, the control unit 10 obtains a level Lps1 of the light emitted from the first mark CMR (maximum grayscale value), which is detected by the first photosensor 31*a* disposed on the first movable semi-circular frame member 20*a* (S21), and obtains a level Lps2 of the light emitted from the first mark CMR (maximum grayscale value), which is detected by the second photosensor 32*a* disposed on the first movable semi-circular frame member 20*a* (S22). Then, the control unit 10 determines whether or not the difference (Lps1−Lps2) between the detected levels Lps1 and Lps2 is greater than a value $\alpha$ that defines the upper limit of a predetermined range ($-\alpha$ to $\alpha$) (S23). Since the first mark CMR has been moved to the right from the center portion in the mark display area 122, the level Lps1 detected by the first photosensor 31*a* located in the movement direction of the first mark CMR more than the second photosensor 32*a* is higher than the level detected by the second photosensor 32*a*. For this reason, the control unit 10 determines that the difference between the detected level Lps1 and the detected level Lps2 (Lps1−Lps2) is greater than the upper limit value $\alpha$ (YES in S23), and a drive control signal is output to cause the first motor 15 to rotate to the right by n steps (S24). When the motor driver 14 drives the first motor 15 in accordance with the drive control signal, the first movable semi-circular frame member 20*a* moves to the right from the center portion. Then, the control unit 10 resets a counter K described below (S25). Thereafter, the control unit 10 repeatedly executes the processing described above (S21 to S25). As a result, the first motor 15 continuously rotates, and therefore the first movable semi-circular frame member 20*a* sequentially moves to the right from the center portion to follow the first mark CMR moving in the mark display area 122 (see FIGS. 6A to 6C and FIGS. 7A to 7E).

Figure 14A:
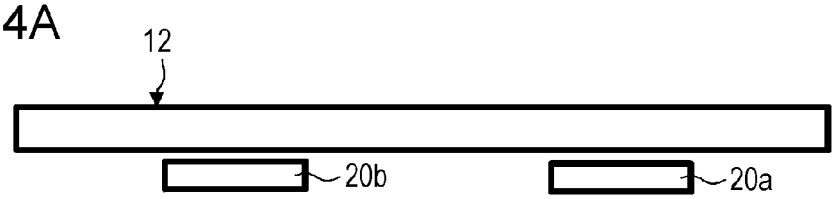
FIGS. 14A and 14B are a plan view and a front view, respectively, of the first movable semi-circular frame member and second movable semi-circular frame member which have moved, and the liquid crystal display panel on which an image object is displayed on the display screen (namely, in the image display area) in association with the first movable semi-circular frame member which has moved.

In this way, the first movable semi-circular frame member 20*a* moves to follow the first mark CMR moving in the mark display area 122. Thus, the speedometer object IO1 displayed in the image display area 121 and the first movable semi-circular frame member 20*a* move with the outer periphery of the speedometer object IO1 and the first movable semi-circular frame member 20*a* fitting into each other so that a state illustrated in FIGS. 13A and 13B is changed to a state illustrated in FIGS. 14A to 14B. In this case, the second movable semi-circular frame member 20*b* also moves in a direction opposite to the direction of the movement of the first movable semi-circular frame member 20*a* to follow the second mark CML in the direction opposite to that of the first mark CMR in the mark display area 122 (see S21 to S25 illustrated in FIG. 10). When the speedometer object IO1 and the first mark CMR reach the correct positions, the speedometer object IO1 stops in the image display area 121, and the first mark CMR and the second mark CML stop in the mark display area 122 (processing of S13*a* and S13*b* illustrated in FIG. 9).

Figure 14B:
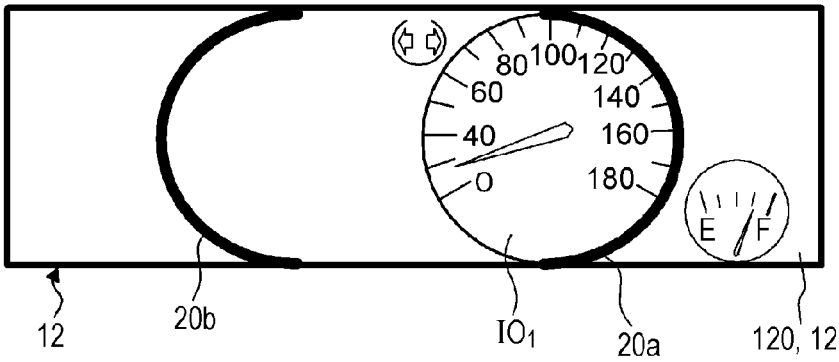

If the control unit 10 determines that the difference (Lps1−Lps2) between the levels of the light emitted from the first mark CMR that has stopped, which are detected by the first photosensor 31*a* and the second photosensor 32*a*, falls within the predetermined range (NO in S23 and NO in S26), the counter K is incremented by +1 (S28), and it is determined whether or not the count value of the counter K has reached a predetermined value Kth (S29). As described above, while the first mark CMR is stopped, it is repeatedly determined that the difference (Lps1−Lps2) between the levels detected by the first photosensor 31*a* and the second photosensor 32*a* falls within the predetermined range (S21 to S23, S26, S28, S29). When the count value of the counter K has reached the predetermined value Kth (S29 in YES), the control of the operation of the first movable semi-circular frame member 20*a* is completed. That is, the first movable semi-circular frame member 20*a* is stopped. Operation control similar to that described above is performed on the second movable semi-circular frame member 20*b*, and the second movable semi-circular frame member 20*b* is also stopped in accordance with the second mark CML that stops in the mark display area 122. As a result, for example, as illustrated in FIG. 14B, the first movable semi-circular frame member 20*a* and the second movable semi-circular frame member 20*b* are spaced apart from each other, and the speedometer object IO1 is displayed in the image display area 121 on the display screen 120 in such a manner that the outer periphery of the speedometer object IO1 is made to fit into the first movable semi-circular frame member 20*a*.

Figure 15A:
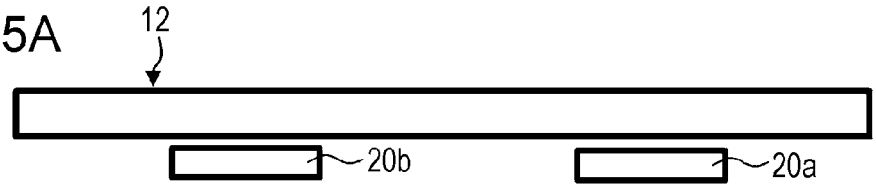
FIGS. 15A and 15B are a plan view and a front view, respectively, of the first movable semi-circular frame member and the second movable semi-circular frame member which have moved, and the liquid crystal display panel on which two image objects are displayed on the display screen (namely, in the image display area) in association with the first movable semi-circular frame member and the second movable semi-circular frame member.

Referring back to FIG. 9, after performing display control (S13: S13*a*, S13*b*) so that, as illustrated in, for example, FIG. 14B, the speedometer object IO1, the first mark CMR, and the second mark CML are displayed at the correct positions, the control unit 10 determines that the display is to be changed to display, for example, an image object of a tachometer (S14 in YES), and obtains new image data including the image object of the tachometer (S11). Then, the control unit 10 performs display control based on the displayed position of the second mark CML using the image data (S12, S13*a*, 13*b*). For example, as illustrated in FIGS. 15A and 15B, an image object IO2 representing a tachometer (hereinafter referred to as the tachometer object IO2) is displayed in the image display area 121 in such a manner that an outer periphery of the image object IO2 fits into the second movable semi-circular frame member 20*b* located spaced apart from the first movable semi-circular frame member 20*a*.

Figure 15B:
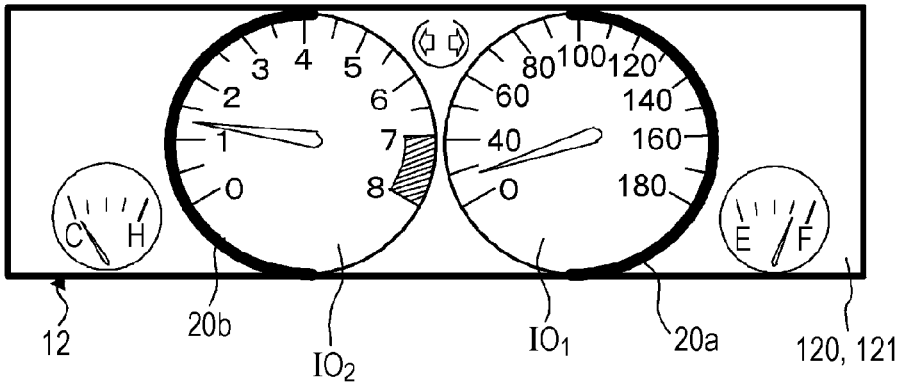

In this manner, as illustrated in FIG. 15B, the speedometer object IO1 and the tachometer object IO2 are displayed side by side (in the image display area 121) on the display screen 120 of the liquid crystal display panel 12, and the first movable semi-circular frame member 20*a* is located so as to fit into the outer periphery of the speedometer object IO1 while the second movable semi-circular frame member 20*b* is located so as to fit into the outer periphery of the tachometer object IO2.

In this state, other image objects are also displayed (in the image display area 121) on the display screen 120 of the liquid crystal display panel 12 under the display control of the control unit 10 based on image data. In addition, image objects of the meter dials included in the speedometer object IO1 and the tachometer object IO2 move on the display screen 120 (image display area 121) under the display control of the control unit 10 based on the travel of the vehicle.

Thereafter, for example, when navigation is started using the operation unit 13, the control unit 10 that executes a process involved in display control in accordance with the procedure illustrated in FIG. 9 determines that the display is to be changed (YES in S14). Then, the control unit 10 obtains new image data including, for example, the speedometer object IO1 and the tachometer object IO2 (S11), and executes display control (S12, S13*a*, S13*b*) using the image data. Through display control, for example, the first mark CMR and the speedometer object IO1 further move to the right from the correct positions, and the second mark CML and the tachometer object IO2 further move to the left from the correct positions so that a state illustrated in FIG. 15B is changed to a state illustrated in FIG. 16B. In this case, the control unit 10 repeatedly executes the process illustrated in FIG. 10 (S21 to S25, S26, S28, S29) described above to control the operation of the first movable semi-circular frame member 20*a* and the second movable semi-circular frame member 20*b*.

Figure 16A:
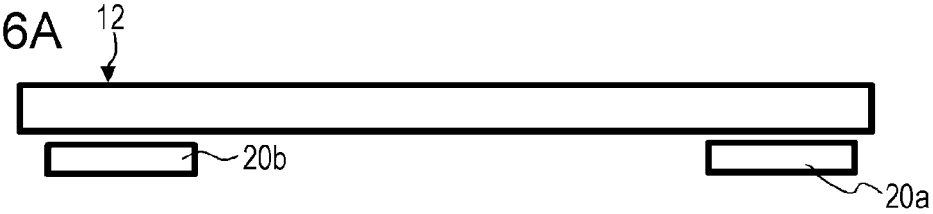
FIGS. 16A and 16B are a plan view and a front view, respectively, of the first movable semi-circular frame member and the second movable semi-circular frame member which have moved, and the liquid crystal display panel on which two image objects are displayed on the display screen (namely, in the image display area) in association with the first movable semi-circular frame member and the second movable semi-circular frame member which have moved.
Figure 16B:
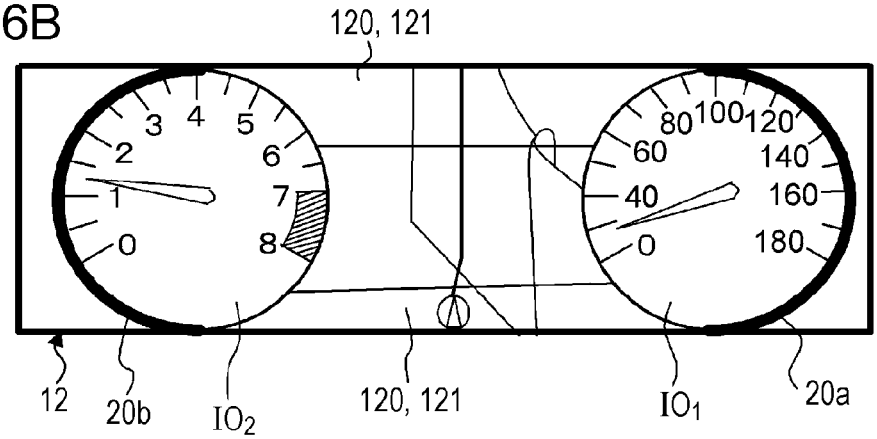

Accordingly, the first movable semi-circular frame member 20*a* that follows the first mark CMR further moves to the right while maintaining the predetermined positional relationship with the speedometer object IO1 displayed in the image display area 121, that is, the positional relationship in which the first movable semi-circular frame member 20*a* fits into the outer periphery of the speedometer object IO1, so that the state illustrated in FIGS. 15A and 15B is changed to a state illustrated in FIGS. 16A and 16B. At the same time, the second movable semi-circular frame member 20*b* that follows the second mark CML further moves to the left while maintaining the predetermined positional relationship with the tachometer object IO2 displayed in the image display area 121, that is, the positional relationship in which the second movable semi-circular frame member 20*b* fits into the outer periphery of the tachometer object IO2.

Thereafter, through separate display control involved in the navigation, for example, as illustrated in FIG. 16B, a road guide map image for the navigation of the vehicle is displayed in an area between the speedometer object IO1 and the tachometer object IO2 in the image display area 121 on the display screen 120.

Figure 17A:
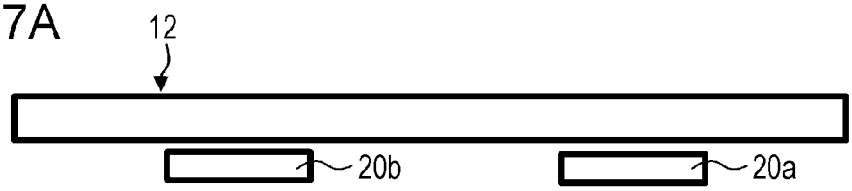
FIGS. 17A and 17B are a plan view and a front view, respectively, of the first movable semi-circular frame member and the second movable semi-circular frame member, and the liquid crystal display panel on which the display of the image object displayed in association with the second movable semi-circular frame member has been omitted among the two image objects displayed on the display screen (namely, in the image display area) in association with the first movable semi-circular frame member and the second movable semi-circular frame member.
Figure 17B:
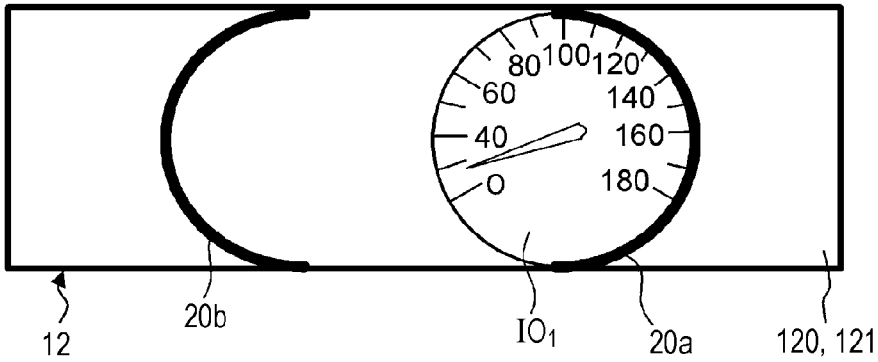

As illustrated in FIGS. 15A and 15B, for example, when an operation of displaying monitoring images of the surroundings of the vehicle is performed using the operation unit 13 (or a transmission shift lever is moved to the rear (R) position) while the speedometer object IO1 and the tachometer object IO2 are displayed at the correct positions in the image display area 121 on the display screen 120 and while the first movable semi-circular frame member 20*a* and the second movable semi-circular frame member 20*b* are located so as to be associated with the image objects IO1 and IO2, the control unit 10 that executes a process involved in display control in accordance with the procedure illustrated in FIG. 9 determines that the display is to be changed (YES in S14). Then, the control unit 10 obtains new image data including the speedometer object IO1 (S11), and executes display control (S12, S13*a*, 13*b*) using the new image data. Through display control, for example, as illustrated in FIGS. 17A and 17B, the display of the tachometer object IO2 in association with the second movable semi-circular frame member 20*b* spaced apart from the first movable semi-circular frame member 20*a* is omitted while the display of the speedometer object IO1 in association with the first movable semi-circular frame member 20*a* is maintained.

Figure 18A:
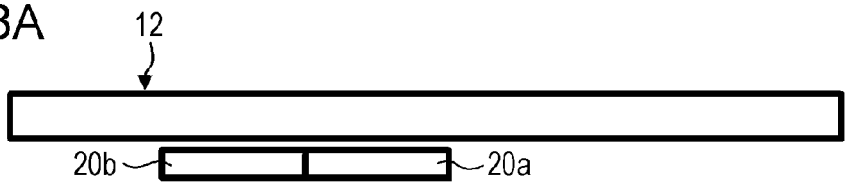
FIGS. 18A and 18B are a plan view and a front view, respectively, of the first movable semi-circular frame member and second movable semi-circular frame member when joining each other, and the liquid crystal display panel on which an image object is displayed on the display screen (namely, in the image display area) in association with the first movable semi-circular frame member and the second movable semi-circular frame member and on which a captured image of the surroundings of a vehicle is displayed.
Figure 18B:
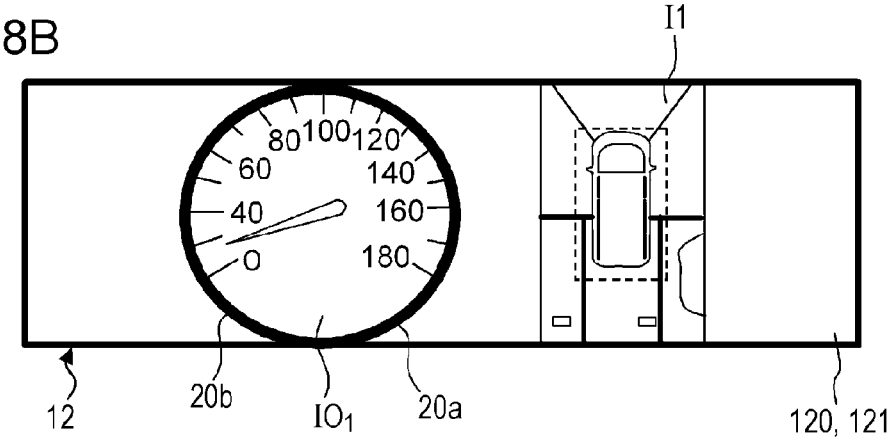

Subsequently, through display control (S13: S13*a*, S13*b*), the first mark CMR and the speedometer object IO1 move to the left from the correct position (see FIG. 17B), and, as illustrated in FIG. 18B, the movement of the first mark CMR and the speedometer object IO1 stops while the outer periphery of the speedometer object IO1 fits into the second movable semi-circular frame member 20*b*, on the basis of the position of the second mark CML. In this case, the control unit 10 controls the operation of the first movable semi-circular frame member 20*a* in accordance with the procedure illustrated in FIG. 10. That is, the control unit 10 determines whether or not the difference (Lps1−Lps2) between the level Lps1 and the level Lps2 of the light emitted from the first mark CMR moving in connection with the speedometer object IO1, which are detected by the first photosensor 31*a* and the second photosensor 32*a*, respectively, exceeds the upper limit value α of the predetermined range (S21, S22, S23). Since the first mark CMR moves to the left in the mark display area 122, the level Lps2 detected by the second photosensor 32*a* located in the movement direction of the first mark CMR more than the first photosensor 31*a* is higher than the level Lps1 detected by the first photosensor 31*a*. For this reason, the control unit 10 determines that the difference (Lps1−Lps2) does not exceed the upper limit value α (NO in S23), and further determines that the difference (Lps1−Lps2) is smaller than the lower limit value −α of the predetermined range (−α to α) (YES in S26). Then, the control unit 10 outputs a drive control signal to cause the first motor 15 to rotate to the left by n steps (S27). When the motor driver 14 drives the first motor 15 in accordance with the drive control signal, the first movable semi-circular frame member 20*a* moves to the left. Then, the control unit 10 resets the counter K (S25). Thereafter, the control unit 10 repeatedly executes the process described above (S21 to S23, S26, S27, S25). As a result, the first motor 15 continuously rotates, and therefore the first movable semi-circular frame member 20*a* sequentially moves to the left to follow the first mark CMR moving in the mark display area 122.

In this way, the first movable semi-circular frame member 20*a* moves to follow the first mark CMR moving in the mark display area 122. Thus, the speedometer object IO1 displayed in the image display area 121 and the first movable semi-circular frame member 20*a* move with the outer periphery of the speedometer object IO1 and the first movable semi-circular frame member 20*a* fitting into each other so that, for example, a state illustrated in FIGS. 17A and 17B is changed to a state illustrated in FIGS. 18A and 18B, until the first movable semi-circular frame member 20*a* joins the second movable semi-circular frame member 20*b*. As described above, when the speedometer object IO1 stops in accordance with the first mark CMR, the control unit 10 determines that the difference (Lps1−Lps2) between the levels of the light emitted from the first mark CMR that has stopped, which are detected by the first photosensor 31*a* and the second photosensor 32*a*, falls within the predetermined range (NO in S23 and NO in S26), and increments the counter K by +1 (S28). Thereafter, while the first mark CMR is stopped, it is repeatedly determined that the difference (Lps1−Lps2) between the detected levels falls within the predetermined range (S21 to S23, S26, S28, S29). When the count value of the counter K has reached the predetermined value Kth (YES in S29), the control of the operation of the first movable semi-circular frame member 20*a* is completed. That is, the first movable semi-circular frame member 20*a* is stopped. As a result, as illustrated in FIG. 18B, the speedometer object IO1 is displayed in a circular frame member formed by joining the first movable semi-circular frame member 20*a* and the second movable semi-circular frame member 20*b*.

Figure 19A:
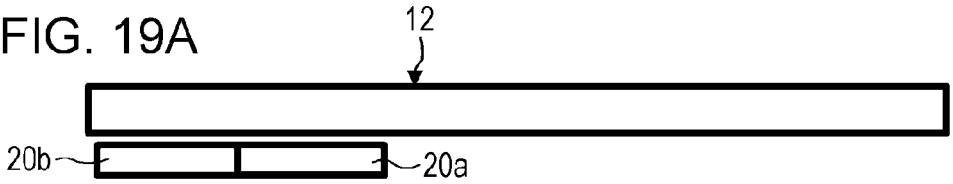
FIGS. 19A and 19B are a plan view and a front view, respectively, of the first movable semi-circular frame member and the second movable semi-circular frame member which have moved while joining each other, and the liquid crystal display panel on which an image object is displayed on the display screen (image display area) in association with the first movable semi-circular frame member and the second movable semi-circular frame member and on which a captured image of the surroundings of the vehicle and a captured image of the rear of the vehicle are displayed.
Figure 19B:
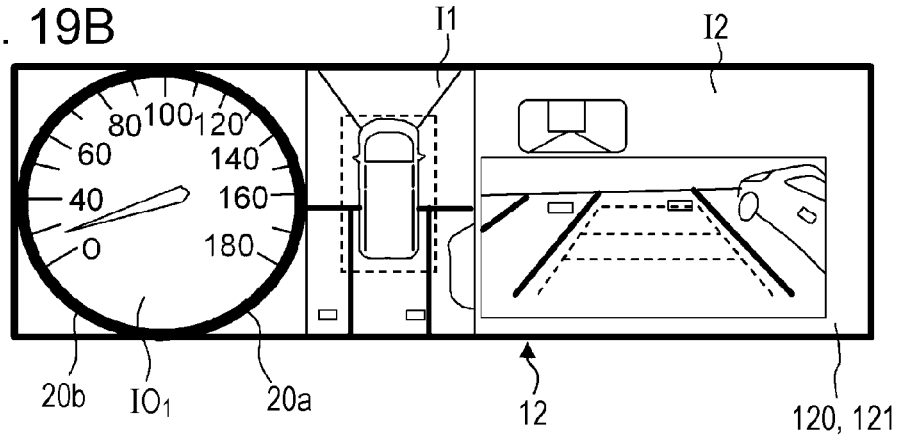

Further, subsequently, through display control (S13: S13*a*, S13*b*), the first mark CMR, the second mark CML, and the speedometer object IO1 further move to the left while maintaining the positional relationship among them, and, as illustrated in FIG. 19B, are stopped when the speedometer object IO1 reaches the left end of the image display area 121. In this case, the control unit 10 repeatedly executes the processing of S21 to S23, S26, S27, and S25 illustrated in FIG. 10 described above to control the operation of the first movable semi-circular frame member 20*a*, and also repeatedly executes the processing of S21 to S25 illustrated in FIG. 10 described above to control the operation of the second movable semi-circular frame member 20*b*. Thus, the first movable semi-circular frame member 20*a* and the second movable semi-circular frame member 20*b* that follow the first mark CMR and the second mark CML, respectively, while joining each other to form a circular frame member move to the left while maintaining the predetermined positional relationship with the speedometer object IO1 displayed in the image display area 121, that is, the positional relationship in which the first movable semi-circular frame member 20*a* and the second movable semi-circular frame member 20*b* fit into the outer periphery of the speedometer object IO1, so that the state illustrated in FIGS. 18A and 18B is changed to a state illustrated in FIGS. 19A and 19B.

Then, as described above, when the speedometer object IO1 stops at the left end of the image display area 121 in accordance with the first mark CMR and the second mark CML, the difference (Lps1−Lps2) between the levels of the light from the first mark CMR, which are detected by the first photosensor 31*a* and the second photosensor 32*a* provided for the first movable semi-circular frame member 20*a*, falls within the predetermined range (−α to α), and the first movable semi-circular frame member 20*a* stops (see S21 to S23, S26, S28, S29). At the same time, the difference (Lps1−Lps2) between the levels of the light from the second mark CML, which are detected by the first photosensor 31*b* and the second photosensor 32*b* provided for the second movable semi-circular frame member 20*b*, falls within the predetermined range (−α to α), and the second movable semi-circular frame member 20*b* stops (see S21 to S23, S26, S28, S29). As a result, as illustrated in FIG. 19B, the speedometer object IO1 is displayed in a circular frame member formed by joining the first movable semi-circular frame member 20*a* and the second movable semi-circular frame member 20*b* at the left end of the display screen 120.

The vehicle has a plurality of cameras, and the control unit 10 controls the display of monitoring images of the surroundings of the vehicle based on the video signals from the respective cameras to display a captured image I1 of the surroundings of the vehicle so as to move to the left from the right side end of the display screen 120 (the image display area 121) in synchronization with the leftward movement of the speedometer object IO1 and the first movable semi-circular frame member 20*a* so that, for example, the state illustrated in FIG. 17B is changed to the state illustrated in FIG. 18B. In addition, the captured image I1 of the surroundings of the vehicle and a captured image 12 of the rear of the vehicle are also displayed so as to move to the left in synchronization with the leftward movement of the speedometer object IO1, the first movable semi-circular frame member 20*a*, and the second movable semi-circular frame member 20*b* so that the state illustrated in FIG. 18B is changed to the state illustrated in FIG. 19B.

The on-vehicle display device described above can provide a user with the image objects, namely, the speedometer object IO1 and the tachometer object IO2, displayed on the display screen 120 of the liquid crystal display panel 12 as live views displayed integrally with the movable members, namely, the first movable semi-circular frame member 20*a* and the second movable semi-circular frame member 20*b*. The first movable semi-circular frame member 20*a* and the second movable semi-circular frame member 20*b* which are arranged to face the display screen 120 of the liquid crystal display panel 12 move in accordance with the movement of the first mark CMR and the second mark CML, which are displayed in the mark display area 122 on the display screen 120, in the mark display area 122, and the speedometer object IO1 and the tachometer object IO2 are displayed in the image display area 121 on the display screen 120 in such a manner that the display positions of the speedometer object IO1 and the tachometer object IO2 displayed in the image display area 121 are related with the positions of the first mark CMR and the second mark CML displayed in the mark display area 122 and are maintained so as to have a predetermined relationship with the positions of the marks MCR and MCL. As a result, the movement of the speedometer object IO1 and the tachometer object IO2 which are displayed in the image display area 121 and the movement of the first movable semi-circular frame member 20*a* and the second movable semi-circular frame member 20*b* which are arranged to face the display screen 120 are associated with each other through the first mark CMR and the second mark CML displayed in the mark display area 122 on the display screen 120 of the liquid crystal display panel 12.

Figure 20A:
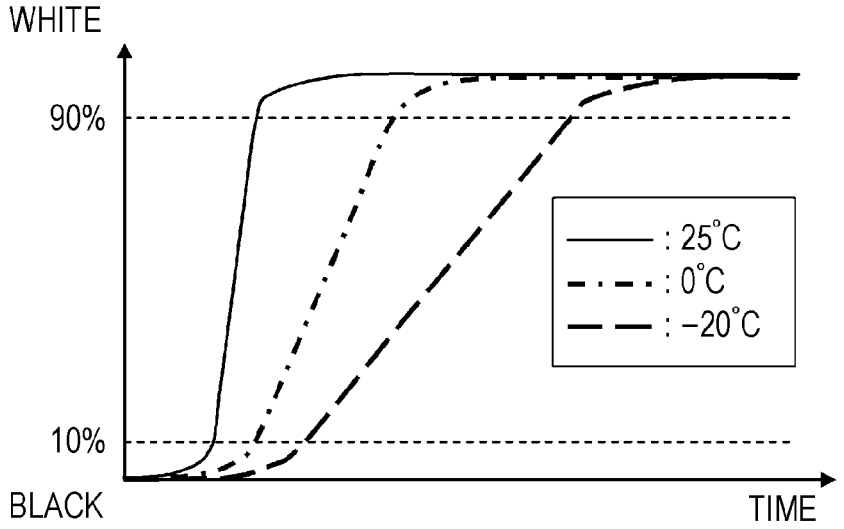
FIG. 20A is a diagram illustrating an example of response speed characteristics of TN and VA liquid crystal display panels with respect to temperatures.
Figure 21A:
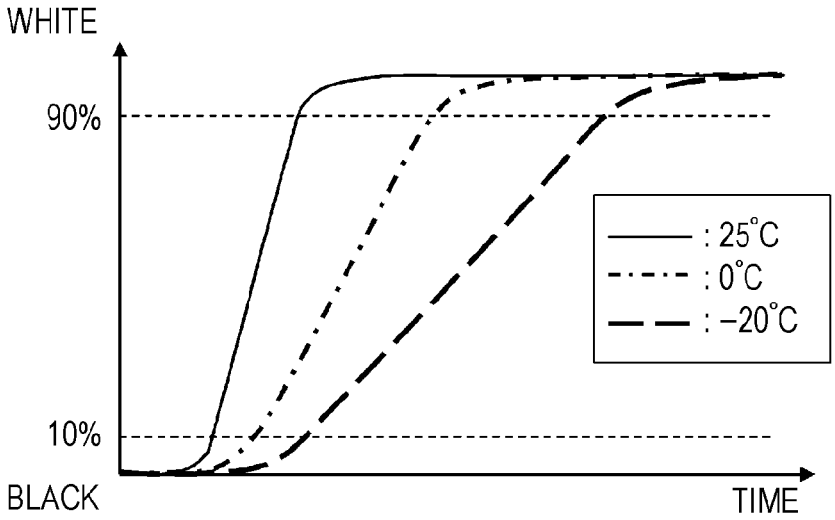
FIG. 21A is a diagram illustrating an example of response speed characteristics of an ISP liquid crystal display panel with respect to temperatures.

Since the image display area 121 and the mark display area 122 on the display screen 120 are included in one liquid crystal display panel 12, the image display area 121 has substantially the same response speed characteristics as the mark display area 122. Accordingly, for example, as indicated by the response speed characteristics of TN and VA liquid crystal display panels illustrated in FIG. 20A and the response speed characteristics of an IPS liquid crystal display panel illustrated in FIG. 21A, even though the response speed characteristics of the liquid crystal display panel 12 change in accordance with temperatures and driving methods, the movement characteristics of an image object displayed in the image display area 121 and the movement characteristics of a mark displayed in the mark display area 122 do not largely differ. Therefore, unlike the related art, corrected data defined for each temperature value or driving method, corrected data for detected positions of movable members (e.g., the first movable semi-circular frame member 20*a* and the second movable semi-circular frame member 20*b*), and the like need not be stored in advance, and the first movable semi-circular frame member 20*a* and the second movable semi-circular frame member 20*b* can be accurately associated with the speedometer object IO1 and the tachometer object IO2 displayed in the display screen 120 (image display area 121), respectively, in a simple manner.

Figure 20B:
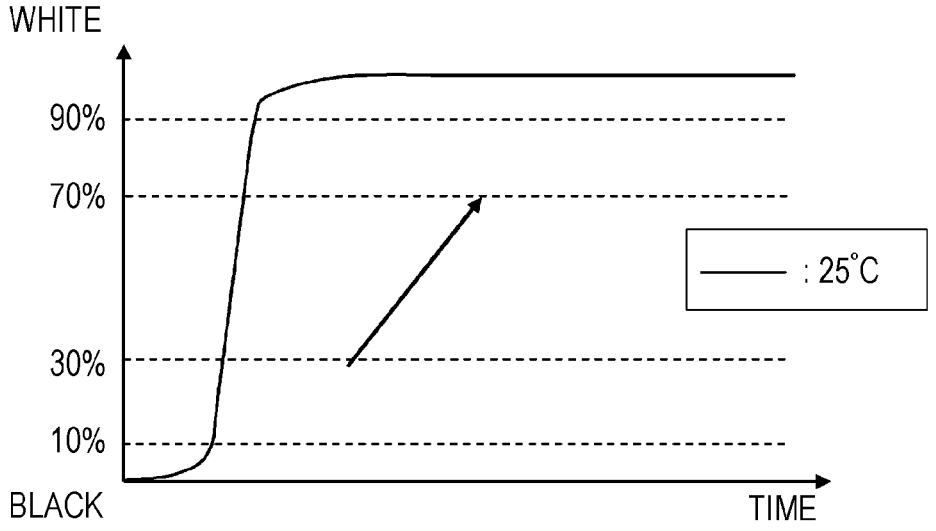
FIG. 20B is a diagram illustrating an example of a difference in characteristics of response speed due to different changes in the varying grayscale (from 10% to 90% and from 30% to 70%) of TN and VA liquid crystal display panels.
Figure 21B:
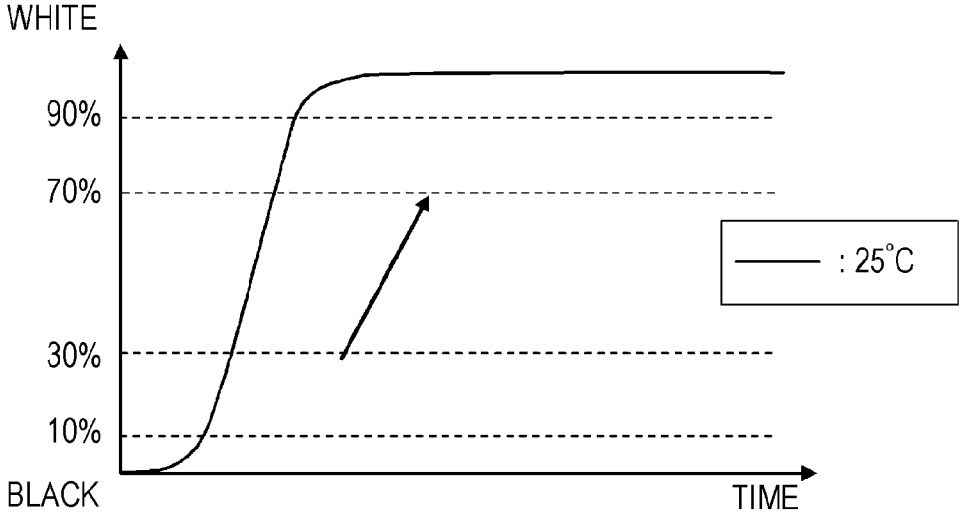
FIG. 21B is a diagram illustrating an example of a difference in characteristics of response speed due to different changes in the varying grayscale (from 10% to 90% and from 30% to 70%) of an ISP liquid crystal display panel.

As indicated by the response speed characteristics of TN and VA liquid crystal display panels illustrated in FIG. 20B and the response speed characteristics of an IPS liquid crystal display panel illustrated in FIG. 21B, as the amount of change in grayscale value increases, the response speed increases (or response characteristics are good). For example, a change in grayscale value from 10% to 90% provides a higher response speed than a change in grayscale value from 30% to 70%. For this reason, as described above, when the speedometer object IO1 and the tachometer object IO2 displayed in the image display area 121 move, in the mark display area 122, the background portion EBK is set to the grayscale value of the darkest portion of the image object and the marks CMR and CML are set to the grayscale value of the brightest portion of the image object. Thus, the movement characteristics of the marks CMR and CML in the mark display area 122 are good, and the movement of the speedometer object IO1 and the tachometer object IO2 displayed in the image display area 121 can be relatively desirably associated with the movement of the marks CMR and CML displayed in the mark display area 122. As a result, the movement of the first movable semi-circular frame member 20*a* and the second movable semi-circular frame member 20*b* in accordance with the movement of the marks CMR and CML displayed in the mark display area 122 can be more desirably associated with the movement of the speedometer object IO1 and the tachometer object IO2 displayed in the image display area 121.

In the foregoing, in the mark display area 122, the background portion EBK is set to the grayscale value of the darkest portion of an image object displayed in the image display area 121, and the marks CMR and CML are set to the grayscale value of the brightest portion of the image object. However, the present invention is not limited to this example. Among a bright portion and a dark portion of the image object whose difference in brightness is greater than or equal to a certain value, for example, whose difference in brightness is greater than or equal to the difference between 30% and 70% in the characteristics illustrated in FIGS. 20B and 21B, the background portion EBK may be set to the grayscale value of the dark portion, and the marks CMR and CML may be set to the grayscale value of the bright portion. Alternatively, the background portion in the mark display area 122 may be fixedly set to a predetermined grayscale value and the marks CMR and CML may be fixedly set to a predetermined grayscale value.

In the foregoing example, the movement of the mark CMR (or CML) is detected using two photosensors 31*a* (or 31*b*) and 32*a* (or 32*b*). Alternatively, three or more photosensors may be used, and the movement of the mark CMR (or CML) may be detected in accordance with changes in the levels of light (the presence or absence of detected light) from the mark CMR (or CML) which are detected by the respective photosensors. Any other technique capable of externally detecting the mark CMR displayed in the mark display area 122 (that emits light) may be used.

As described above, a display device according to an embodiment of the present invention is advantageously capable of accurately associating a movable member and an image object displayed on a display screen with each other in a simple manner, and may be effectively used as a display device that displays an image on a display screen of a liquid crystal display panel.

Although preferred embodiments have been described in detail, the present invention is not limited to these specific embodiments. Rather, various modifications and changes can be made without departing from the scope of the present invention as described in the accompanying claims. Accordingly, all such modifications are intended to be included within the scope of this invention as defined in the following claims.

What is claimed is:

1. A display device comprising:

a liquid crystal display panel having a display screen;

a movable member arranged to face the display screen of the liquid crystal display panel in overlapping relation;

a movable member driving mechanism configured to move the movable member in front of and along a dimension of the display screen;

a display control unit configured to control display of a movable image object in a first display area of the display screen and control display and movement of a predetermined mark in a second display area of the display screen;

a drive control unit configured to control the movable member driving mechanism so that the movable member tracks movement of the mark displayed in the second display area; and wherein the display control unit is configured to control display of the movable image object in the first display area and control display and movement of the mark in the second display area so that a position of the image object displayed in the first display area and a position of the mark displayed in the second display area along the dimension of the display screen correspond to each other.

2. The display device according to claim 1, wherein the display control unit includes:

a first image display control unit configured to control display of the image object in the first display area;

a second image display control unit configured to control display of the mark in the second display area; and wherein the first image display control unit and the second image display control unit control display of the image object in the first display area and control the mark in the second display area so that the position of the image object displayed in the first display area and the position of the mark in the second display area correspond to each other.

3. The display device according to claim 2, wherein the first image display control unit includes a displayed image object position control unit configured to control the position of the image object displayed in the first display area in accordance with the position of the mark displayed in the second display area.

4. The display device according to claim 1, wherein the display control unit performs display control so that a background portion in the second display area is displayed with the same brightness as a dark portion in the image object displayed in the first display area, and the mark is displayed with the same brightness as a bright portion in the image object displayed in the first display area, wherein a difference in brightness between the bright portion and the dark portion is greater than or equal to a predetermined value.

5. The display device according to claim 4, wherein the bright portion is equivalent to a brightest portion in the image object, and the dark portion is equivalent to a darkest portion in the image object.

6. The display device according to claim 1, wherein the drive control unit further includes:

a mark movement detection unit configured to detect movement of the mark displayed in the second display area; and an operation control unit configured to control an operation of the movable member driving mechanism in accordance with the movement of the mark.

7. The display device according to claim 1, wherein the movable member driving mechanism is configured to drive the movable member to linearly move while facing the display screen.

8. The display device according to claim 7, wherein the drive control unit further includes a mark movement detection unit configured to detect movement of the mark displayed in the second display area; and an operation control unit configured to control an operation of the movable member driving mechanism based on the movement of the mark so that the movable member follows movement of the mark moving in the second display area.

9. The display device according to claim 8, wherein the mark movement detection unit includes a plurality of light detectors arranged to face the second display area and configured to detect light emitted from the mark displayed in the second display area; and wherein a change in level of the light detected by each of the plurality of light detectors is detected as a movement of the mark.

10. The display device according to claim 9, wherein the plurality of light detectors are provided in the movable member.

11. The display device according to claim 10, wherein the plurality of light detectors include a first light detector and a second light detector, which are placed at a predetermined interval in a direction in which the second display area extends along the display screen; and wherein the operation control unit controls the movable member driving mechanism to drive the movable member so that a difference between a level of the light detected by the first light detector and a level of the light detected by the second light detector is maintained within a predetermined range.

12. The display device according to claim 1, wherein the display screen is rectangular; and wherein the display screen includes an area having a first width from a top side thereof, and an area below the first display area and having a second width smaller than the first width, the area having the first width being set as the first display area and the area having the second width being set as the second display area.

13. A method of controlling a display screen of a liquid crystal display panel, the method comprising:

providing a movable member arranged to face the display screen of the liquid crystal display panel in overlapping relation;

moving the movable member in front of and along a dimension of the display screen using a movable member driving mechanism;

controlling display of a movable image object in a first display area of the display screen and controlling display and movement of a predetermined mark in a second display area of the display screen, using a display control unit;

controlling the movable member driving mechanism so that the movable member tracks movement of the mark displayed in the second display area; and controlling display of the movable image object in the first display area and controlling display and movement of the mark in the second display area so that a position of the image object displayed in the first display area and a position of the mark displayed in the second display area along the dimension of the display screen correspond to each other.

14. The method according to claim 13, including:

controlling display of the image object in the first display area using a first image display control unit;

controlling display of the mark in the second display area using a second image display control unit; and controlling display of the image object in the first display area and controlling the mark in the second display area so that the position of the image object displayed in the first display area and the position of the mark in the second display area correspond to each other.

15. The method according to claim 14, further including:

controlling the position of the image object displayed in the first display area in accordance with the position of the mark displayed in the second display area using a displayed image object position control unit.

16. The method according to claim 13, further including:

controlling the display screen so that a background portion in the second display area is displayed with the same brightness as a dark portion in the image object displayed in the first display area, and so that the mark is displayed with the same brightness as a bright portion in the image object displayed in the first display area, wherein a difference in brightness between the bright portion and the dark portion is greater than or equal to a predetermined value.

17. The method according to claim 16, wherein the bright portion is equivalent to a brightest portion in the image object, and the dark portion is equivalent to a darkest portion in the image object.

* * * * *